US007661999B2

(12) United States Patent
Horiuchi et al.

(10) Patent No.: US 7,661,999 B2
(45) Date of Patent: Feb. 16, 2010

(54) CONNECTOR

(75) Inventors: Masaya Horiuchi, Yokkaichi (JP); Emi Sakakura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/236,565

(22) Filed: Sep. 24, 2008

(65) Prior Publication Data

US 2009/0111318 A1 Apr. 30, 2009

(30) Foreign Application Priority Data

Oct. 26, 2007 (JP) ..... 2007-278403

(51) Int. Cl.
*H01R 13/514* (2006.01)

(52) U.S. Cl. ..... 439/752; 439/595

(58) Field of Classification Search ..... 439/752, 439/595

See application file for complete search history.

(56) References Cited

U.S. PATENT DOCUMENTS 6,902,416 B2 * 6/2005 Feldman ..... 439/219
7,066,773 B1 * 6/2006 Martin ..... 439/752
7,347,744 B2 * 3/2008 Tabata et al. ..... 439/752
7,390,228 B2 * 6/2008 Rimke ..... 439/752

FOREIGN PATENT DOCUMENTS

JP 2006216323 8/2006

* cited by examiner

*Primary Examiner*—Truc T Nguyen
(74) *Attorney, Agent, or Firm*—Gerald E. Hespos; Anthony J. Casella

(57) ABSTRACT

A connector (S) includes a housing (10) having an insertion hole (16) formed through three adjacent surfaces of the housings (10) and communicating with cavities (11). A retainer (50) is inserted into the insertion hole (16) through an insertion port (16A) in a first of the three adjacent surfaces of the housing (10) and locks terminal fittings (98). A front holder (30) is mounted on the housing (10) from a front end thereof and has side panels (32A) that cover portions of the insertion hole (16) in the second and third surfaces while leaving the insertion port (16A) open. The retainer (50) slides on inner surfaces of the side panels (32A) of the front holder (30).

11 Claims, 28 Drawing Sheets

CONNECTOR

BACKGROUND OF THE INVENTION

1. Field of the Invention

The invention relates to a connector.

2. Description of the Related Art

Japanese Patent Application Laid-Open No. 2006-216323 discloses a connector that has a housing with cavities and terminal fittings that are inserted into the cavities. An insertion hole extends into three adjacent surfaces of the housing and intersects the cavities. The connector also includes a retainer that can be inserted sufficiently into the insertion hole to engage the terminal fittings and to retain the terminal fittings in the cavities.

The guide hole is formed in the three adjacent surfaces of the housing, and hence the retainer is not restrained in a width direction orthogonal to the movement direction of retainer. Accordingly, a vertically long guide hole is formed on the side surface of the housing facing into the insertion hole and a guide projects from the side surface of the retainer. The guide advances longitudinally along the guide hole to guide the insertion of the retainer. However, the guide and the guide hole complicate the construction of the housing.

The invention has been completed in view of the above-described situation, and an object of the invention to simplify the construction of a housing.

SUMMARY OF THE INVENTION

The invention relates to a connector with a housing that has cavities and terminal fittings that are inserted longitudinally into the cavities. An insertion hole is formed in three adjacent surfaces of the housing and intersects the cavities. A retainer is inserted into the insertion hole through an insertion port formed in one of the three surfaces of the housing and locks the terminal fittings that have been inserted properly into the cavities. A front holder is mounted on the housing from the front end thereof and covers a front surface of the housing and at least two of the three adjacent surfaces of the housing. Thus, the front holder closes substantially the entire insertion hole except the insertion port. The front holder also has a side wall, and an inner surface of the side wall for slidably receives a side surface of the retainer. Thus, the front holder guides the movement of the retainer, and the housing does not need a construction for guiding the movement of the retainer. Accordingly, the construction of the connector housing is simplified.

A retainer lock preferably is provided on the side surface of the retainer, and a to-be-locked portion is provided on an inner surface of the side wall of the front holder. The retainer lock locks the to-be-locked portion thereto when the retainer is inserted into the insertion hole in a normal state to prevent removal of the retainer. Thus, the housing does not need a retainer to-be-locked portion and the construction of the housing is simplified further.

The retainer lock preferably locks the retainer to-be-locked portion in an incomplete state when the retainer is inserted incompletely into the insertion hole. However, the incompletely inserted retainer causes corresponding portions of the side wall to expand outward. Thus, the incompletely inserted state of the retainer can be detected from the outside.

The front holder preferably has a closed loop-shaped holder insertion port that communicates with the insertion hole of the housing. An end of the retainer fits in the holder insertion port when the retainer is fit into the housing in a predetermined normal state. Therefore the front holder and the retainer are locked to each other in a direction in which the front holder separates from the housing to prevent removal of the front holder.

The holder insertion port preferably is open at a rear end of the side wall and communicates with the insertion port of the housing. Thus, it is possible to shorten the longitudinal lengths of the housing and the front holder. The retainer can be separated from the housing by inserting a jig into the holder-side ingress hole from the open side thereof.

DETAILED DESCRIPTION OF THE PREFERRED EMBODIMENTS

Figure 1:
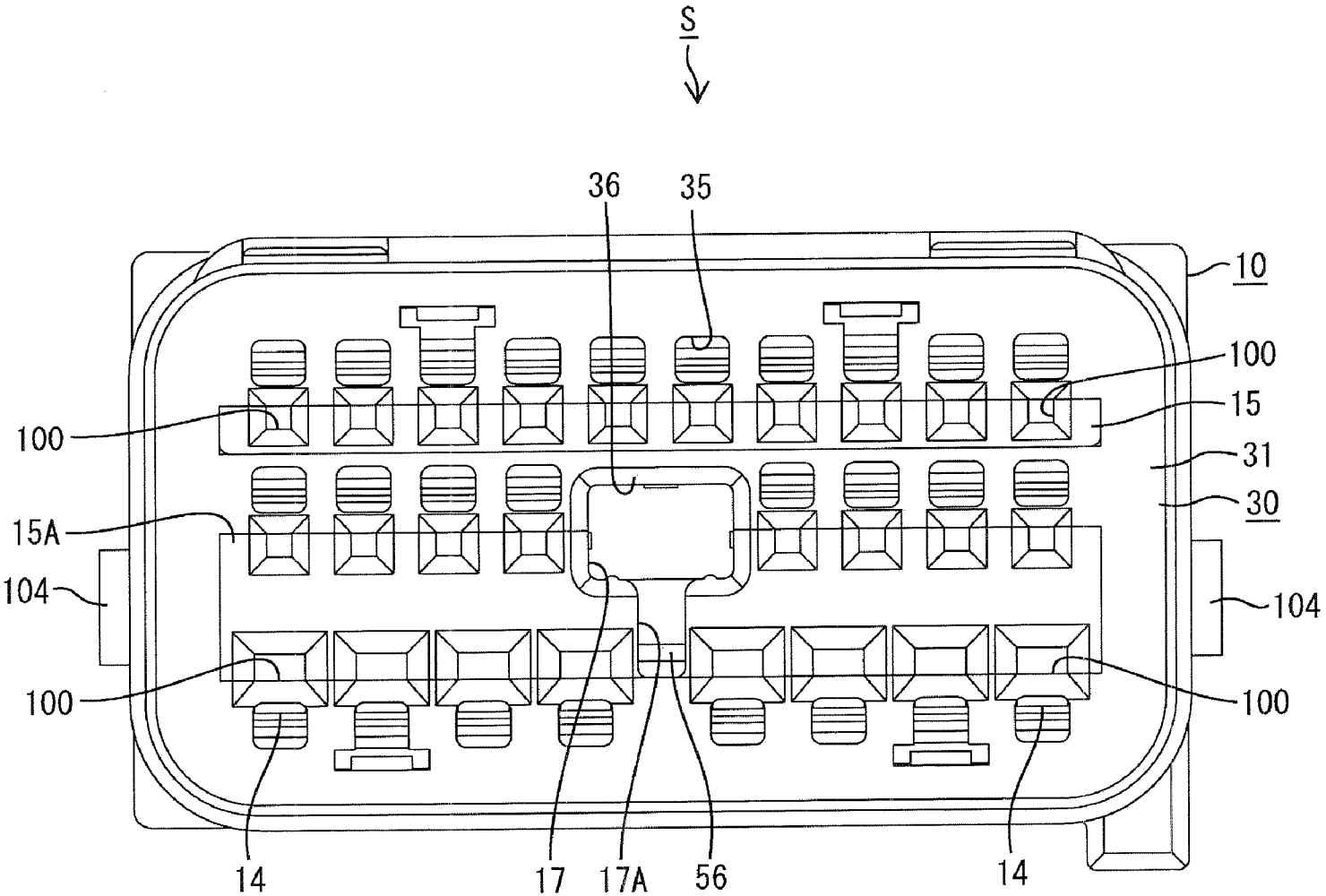
FIG. 1 is a front view showing a state in which a front holder is mounted on a housing in a first embodiment of the invention.
Figure 2:
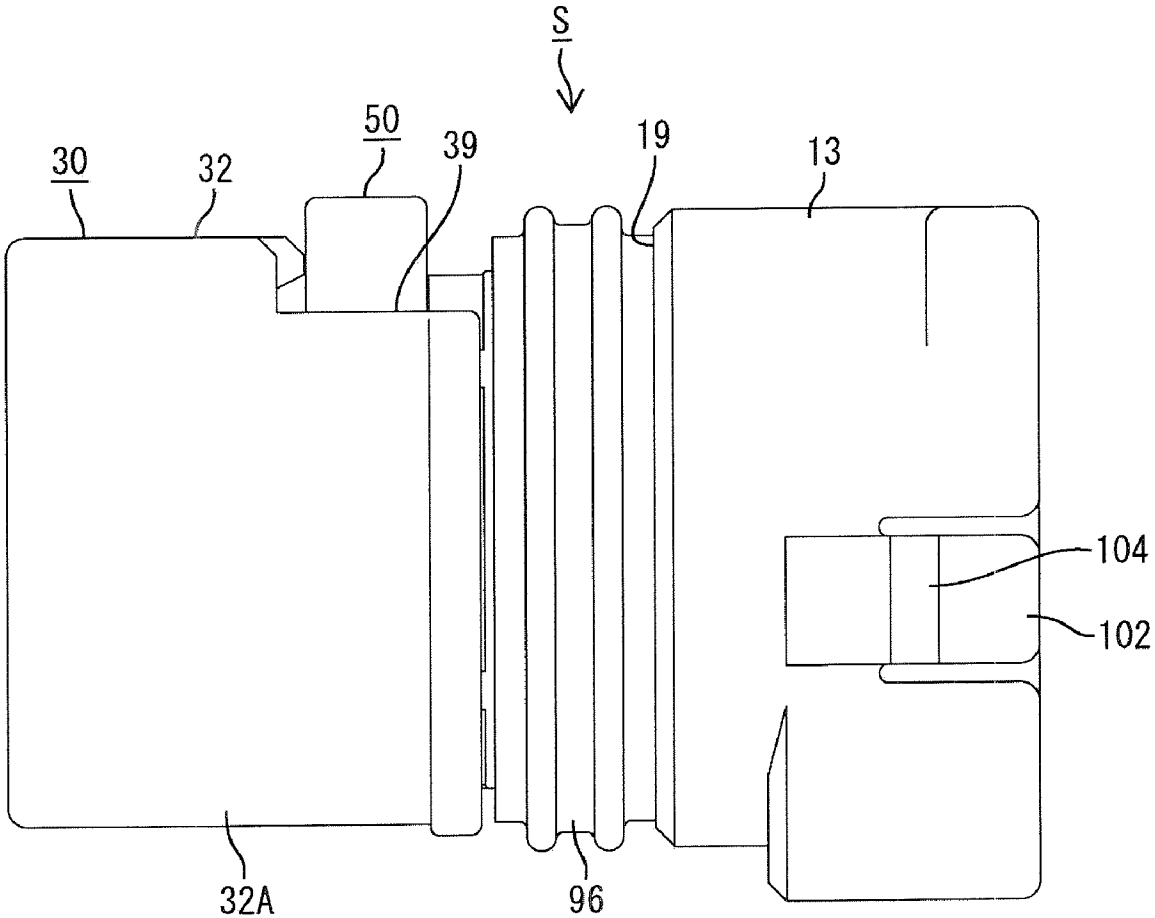
FIG. 2 is a side elevation showing the front holder mounted on the housing and a retainer held at a temporary locking position.
Figure 3:
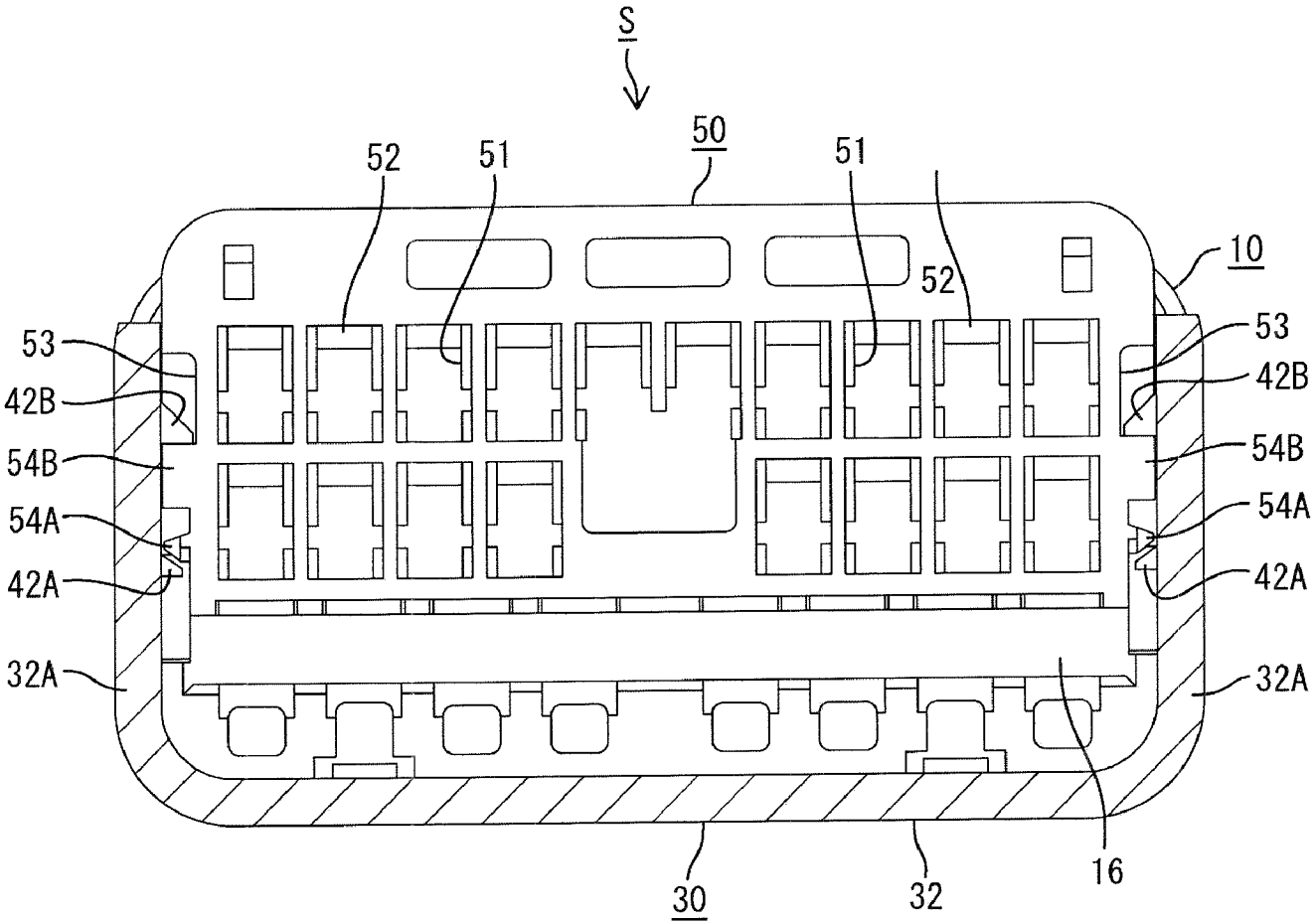
FIG. 3 is a vertical sectional view showing the front holder mounted on the connector and the retainer held at the temporary locking position.
Figure 4:
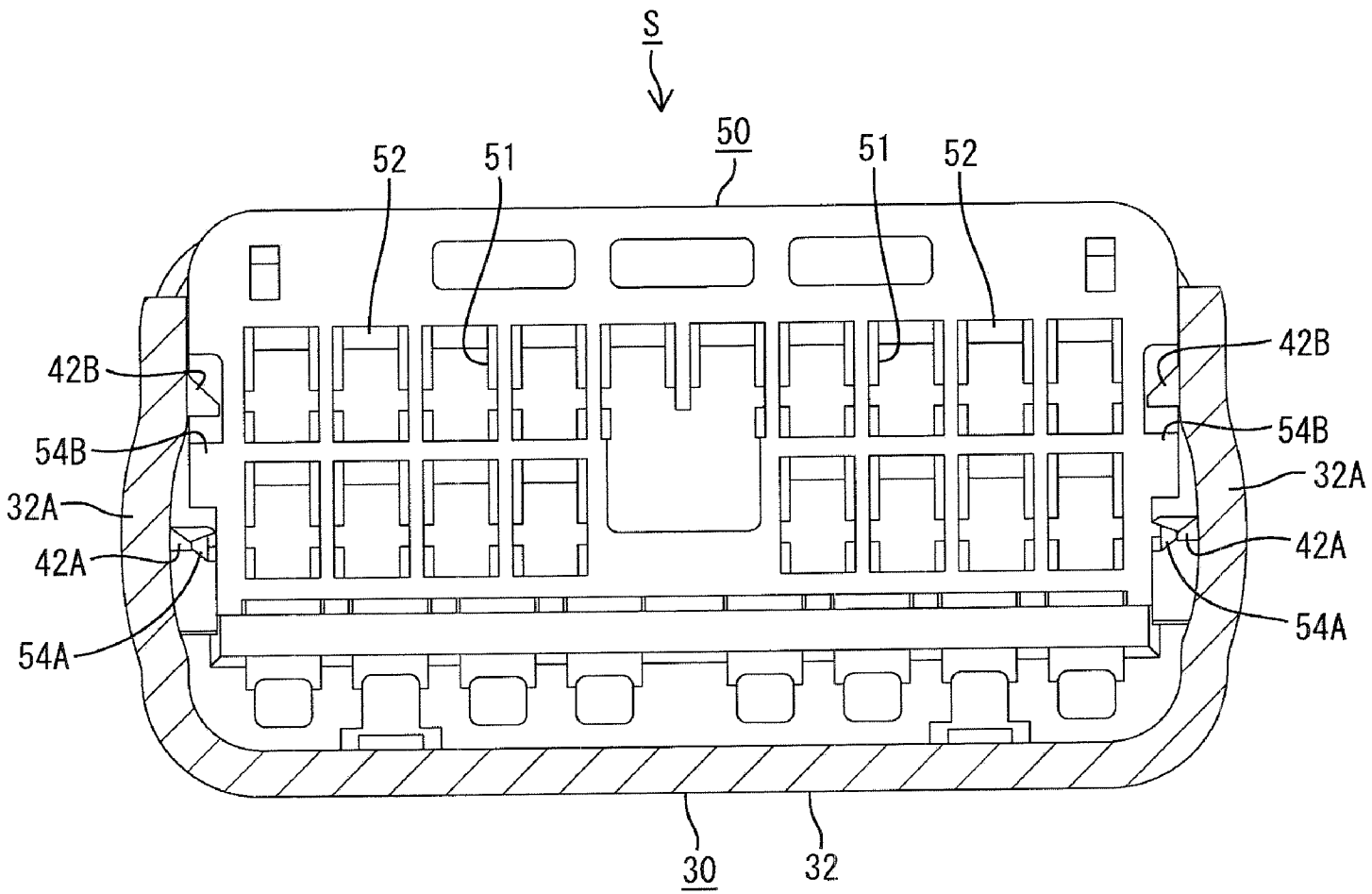
FIG. 4 is a vertical sectional view showing the front holder mounted on the housing and the retainer moved from a temporary locking position to a main locking position.
Figure 5:
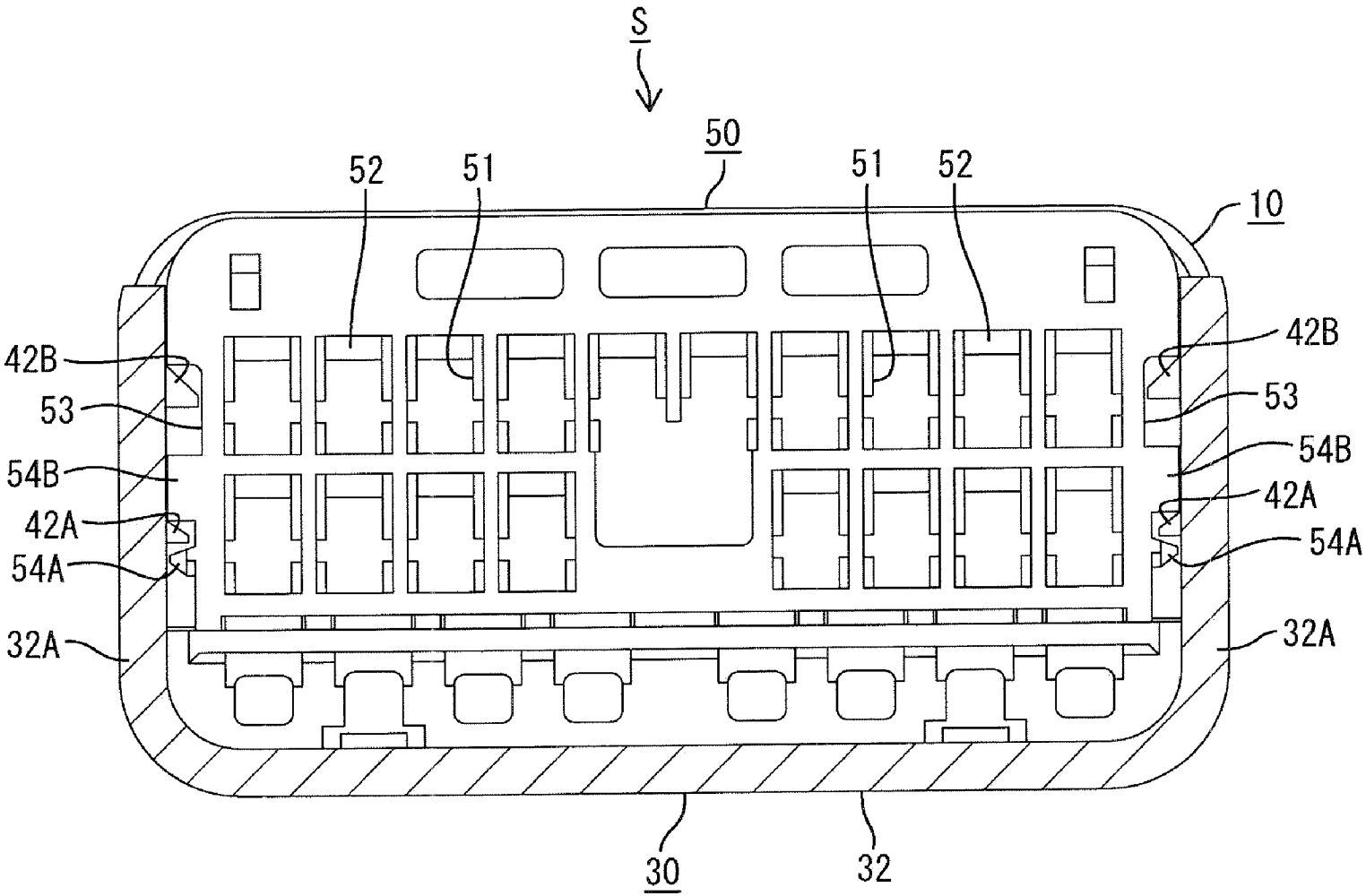
FIG. 5 is a vertical sectional view showing the front holder mounted on the housing and the retainer held at the main locking position.
Figure 6:
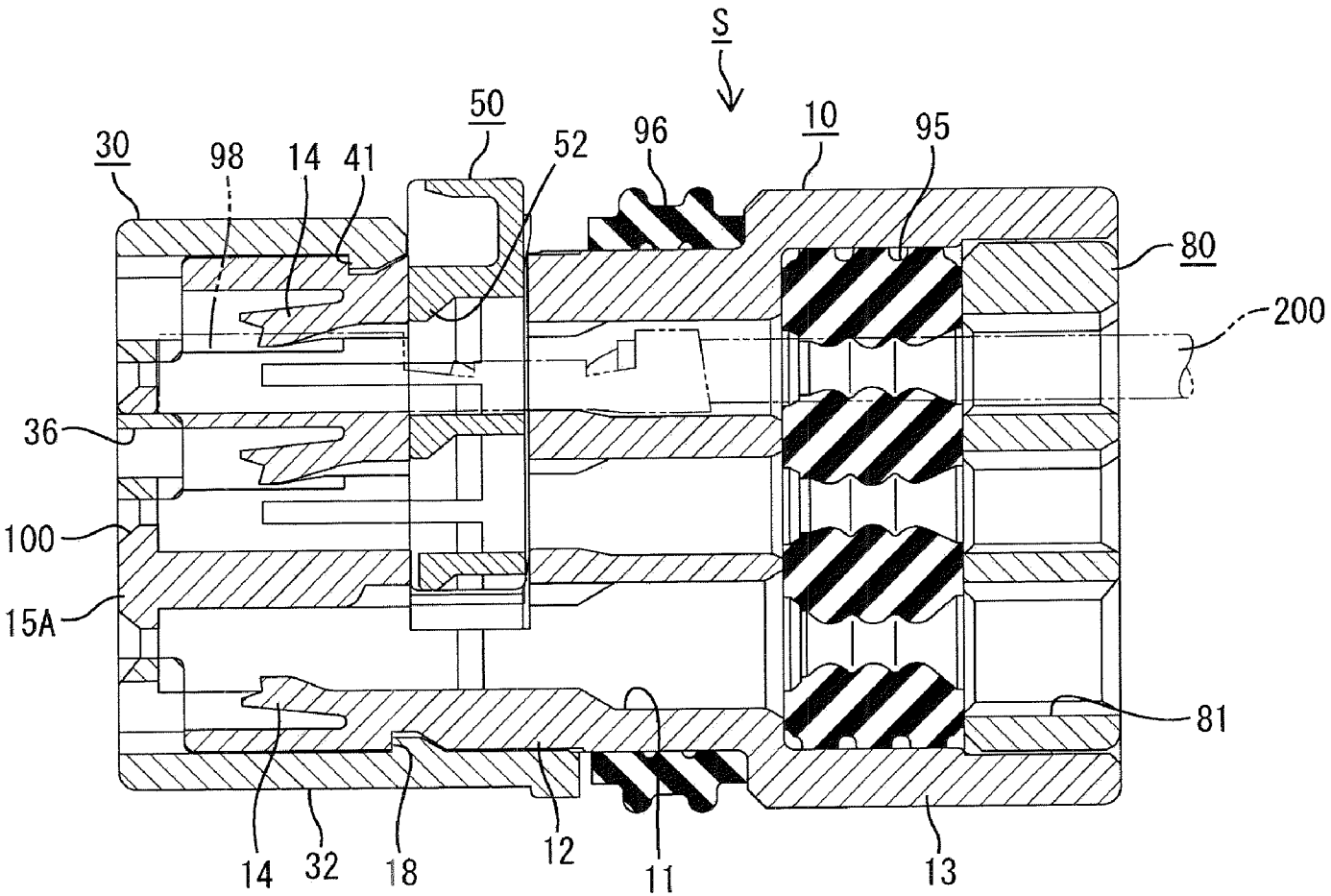
FIG. 6 is a side sectional view showing the front holder mounted on the housing and the retainer is held at the temporary locking position.
Figure 7:
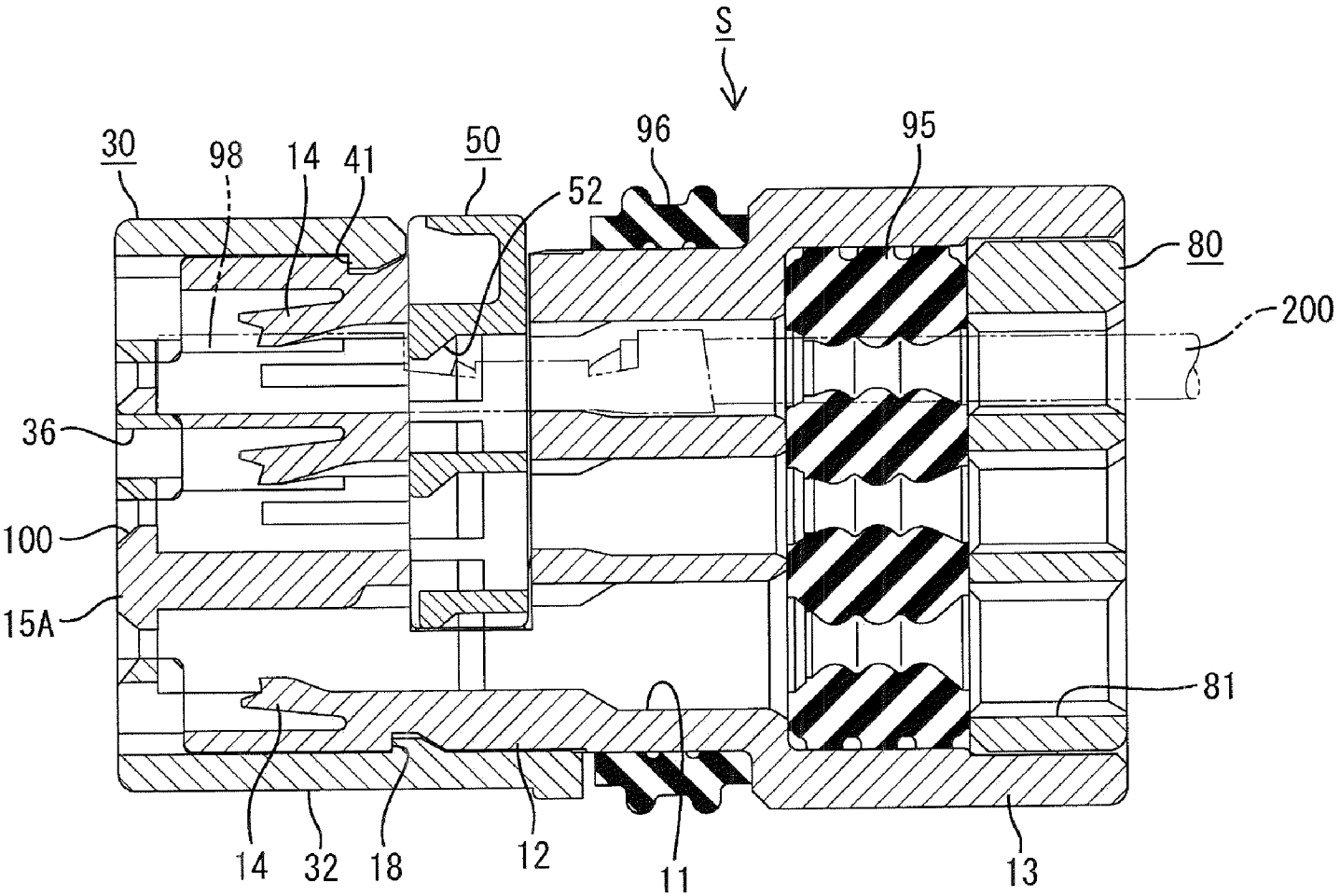
FIG. 7 is a side sectional view showing the front holder is mounted on the housing and the retainer held at the main locking position.

A first embodiment of the invention is described below with reference to FIGS. 1 through 27. A connector S of the first embodiment has a housing 10, a mating housing 90, a front holder 30, a retainer 50, a frame 70, a rear holder 80, a seal 95, a seal ring 96, a lever 97 and terminal fittings 98. The housing 10, the mating housing 90, the front holder 30, the retainer 50, the frame 70, the rear holder 80, and the lever 97 are made of synthetic resin. The seal 95 and the seal ring 96 are made of rubber and the terminal fittings 98 are made of a conductive metal. In the description made below, the fit-in end of the housing 10 and the mating 90 are referred to as the front ends, and the vertical direction is based on that of FIG. 1.

Figure 24:
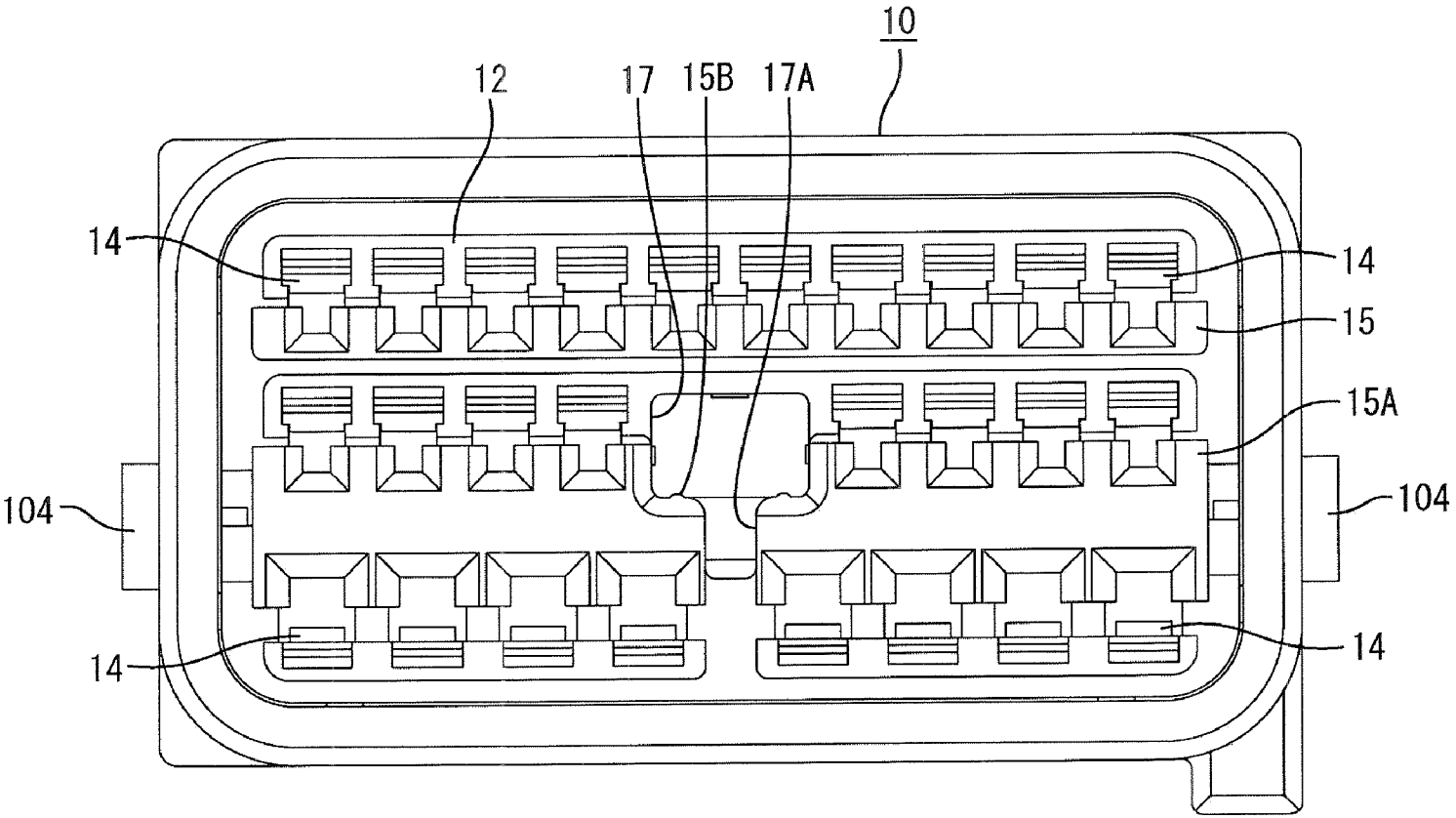
FIG. 24 is a front view of the housing.
Figure 25:
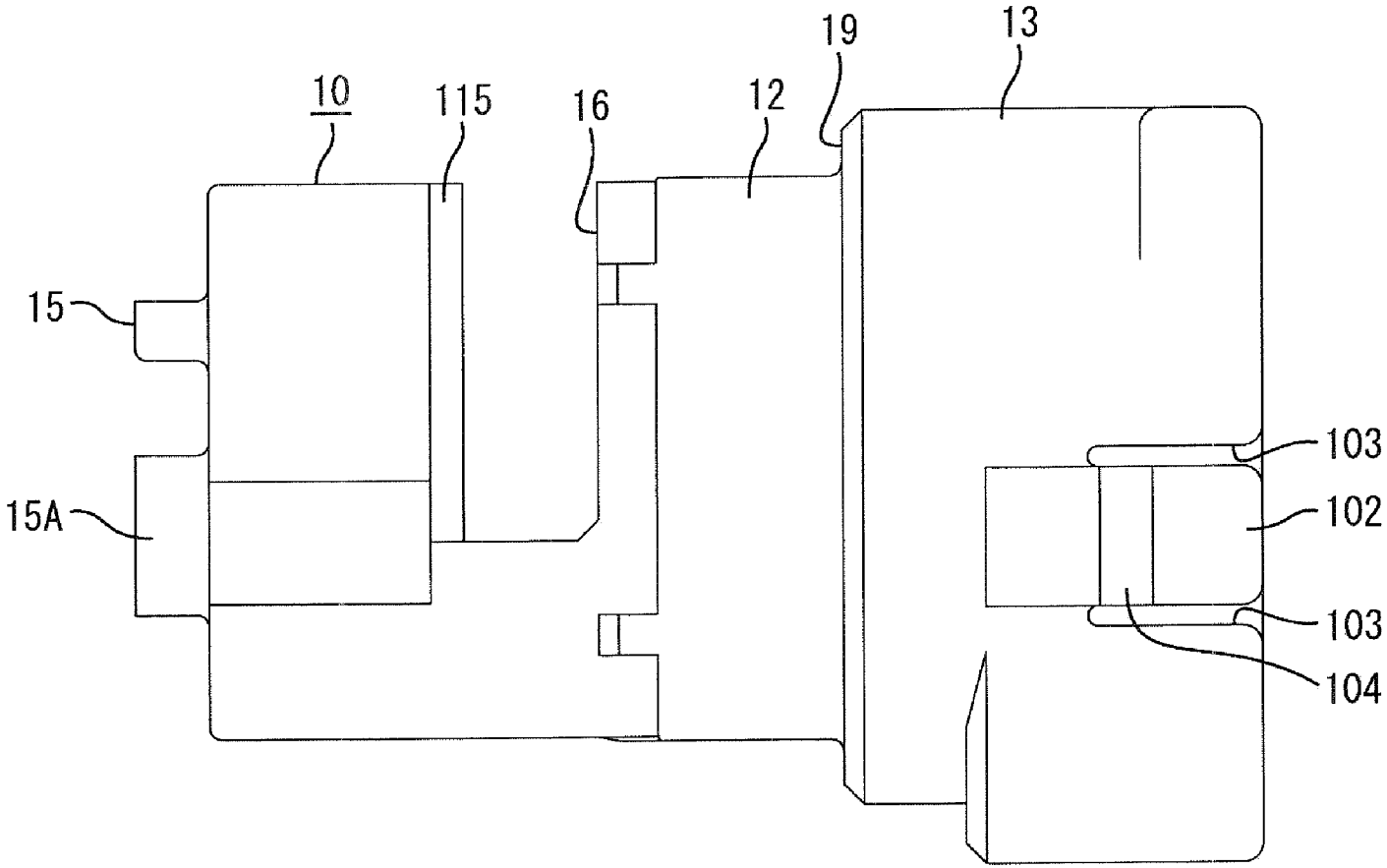
FIG. 25 is a side elevation of the housing.
Figure 26:
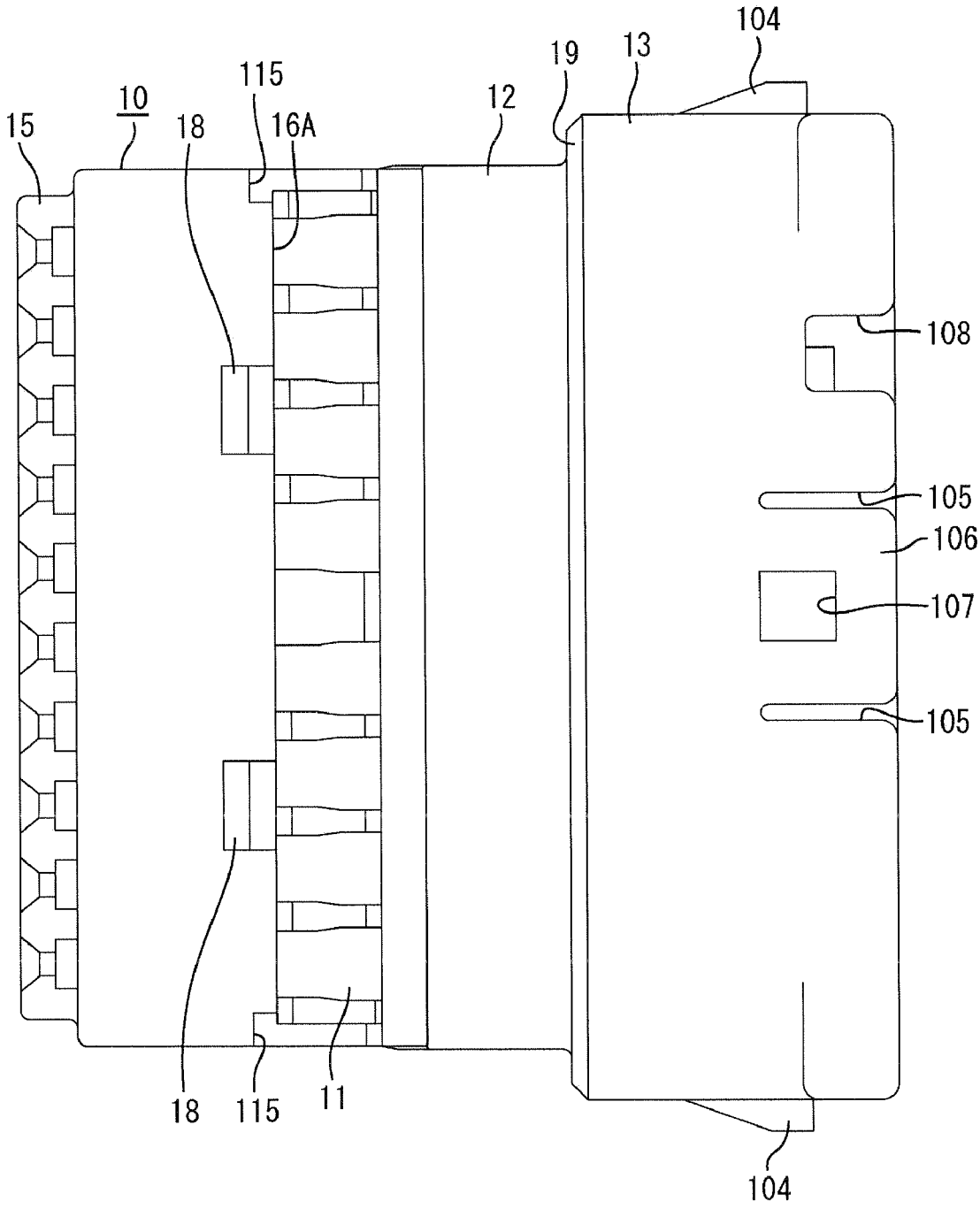
FIG. 26 is a plan view of the housing.
Figure 27:
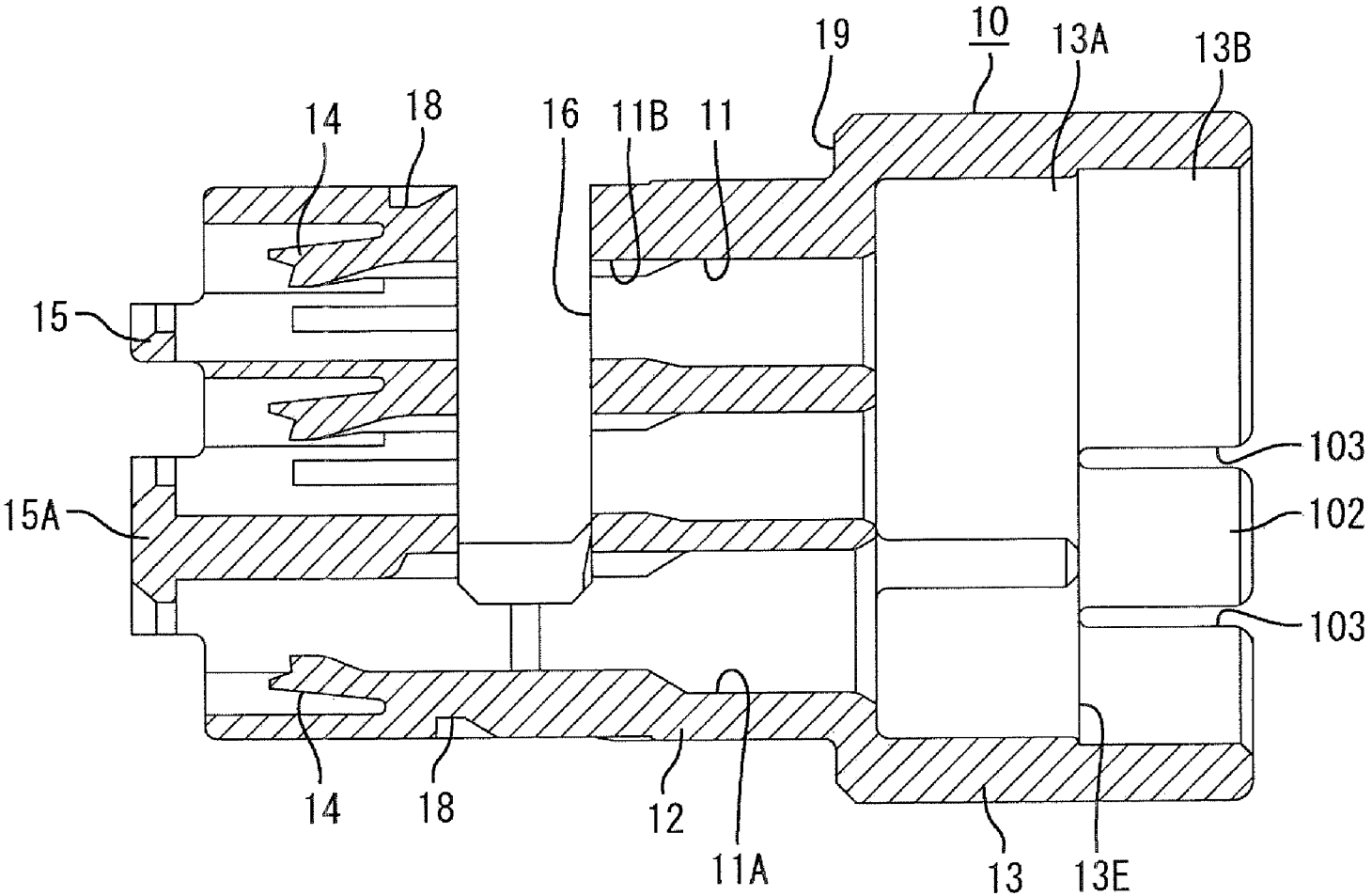
FIG. 27 is a side sectional view of the housing.

The housing 10 can be fit in a housing-accommodating chamber 71 of the frame 70 and several of the housings 10 having the same configuration are prepared as sub-connector housings. As shown in FIGS. 24 and 27, the housing 10 includes a quadrangular block-shaped main body 12 and a quadrangular tubular concavity 13 that projects rearward from the rear surface of the main body 12. Cavities 11 penetrate longitudinally through the main body 12 at three stages vertically arranged stages. The cavities 11 include large and small cavities 11A and 11B. The large cavities 11A are at a lower stage and are configured for receiving large terminal fittings 98. The small cavities 11B are at upper and intermediate stages and are configured for receiving small terminal fittings 98.

The terminal fittings 98 are inserted into the cavities 11 of the main body 12 from the rear. Flexible lances 14 are provided on an inner wall of each cavity 11 for locking the terminal fittings 98 that have been inserted into the respective cavities 11 to a normal state. The lances 14 for locking the small terminal fittings 98 are provided on an upper surface of an inner wall of the small cavity 11B, whereas the lances 14 for locking the large terminal fittings 98 are provided on a lower surface of an inner wall of the large cavities 11A. Thus, the directions in which the terminal fittings 98 are locked to the two kinds of the lances are opposite to each other.

A portion of the main body 12 forward from the lance 14 is open and is configured for receiving a front wall 31 of the front holder 30. A housing-side front surface portion 15 projects forward on the front of the main body 12 at a position forward from the lances 14 and is capable of contacting and holding the terminal fittings 98. The housing-side front surface portion 15 is continuous with a holder-side front surface portion 33 (see FIG. 18) on the front wall 31 of the front holder 30 to form a guide port 100 around the entire periphery of the housing-side front surface portion 15 (see FIG. 1) for receiving a mating tab 99. Left and right front surface projections 15A are provided on the housing-side front surface portion 15 and form lower halves of a front surface of each intermediate-stage cavity 11 and upper halves of a front surface of each lower-stage cavity 11.

An insertion hole 16 is formed through three adjacent surfaces of the main body 12 at an approximately central longitudinal position of the main body 12. The insertion hole 16 communicates with the cavities 11 at all the three stages and intersects the cavities 11 approximately perpendicularly. The insertion hole 16 is rearward from the lance 14 and vertically penetrates a thick portion of the housing main body 12 that is rearward from a root of the lance 14. A portion of the insertion hole 16 formed in the upper surface of the housing 10 defines an insertion port 16A for receiving the retainer 50. The insertion port 16A (see FIG. 26) is formed over the entire width of the main body 12 and communicates with the adjacent two openings disposed at both sides of the insertion port 16A so that the insertion port 16A and the adjacent openings of the insertion hole 16 are disposed at right angles.

Figure 8:
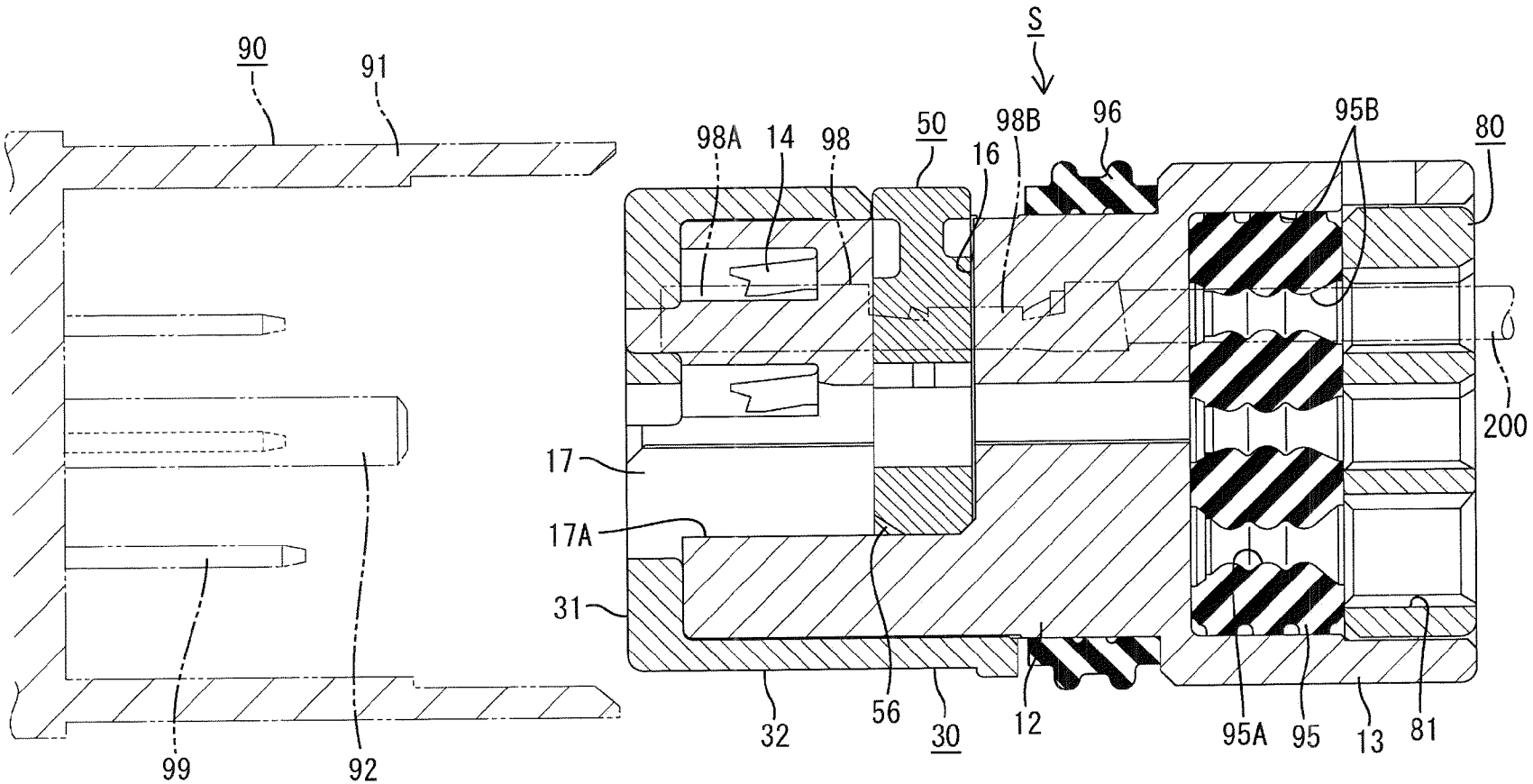
FIG. 8 is a side sectional view showing a state before the housing is fit in a mating housing.
Figure 9:
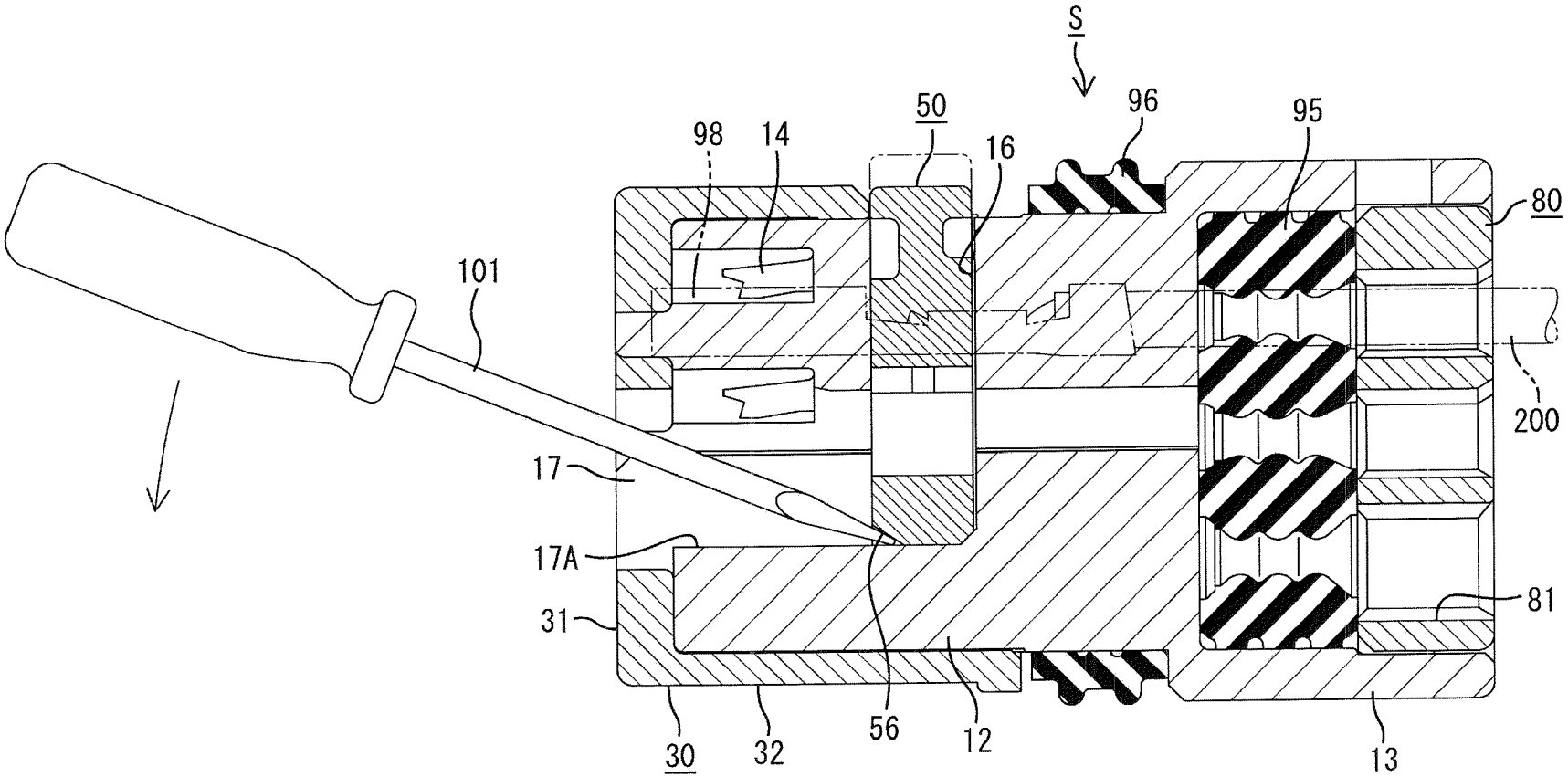
FIG. 9 is a side sectional view showing a state in which a jig is operated, with a tip of the jig engaged with a receiving portion of the retainer.
Figure 10:
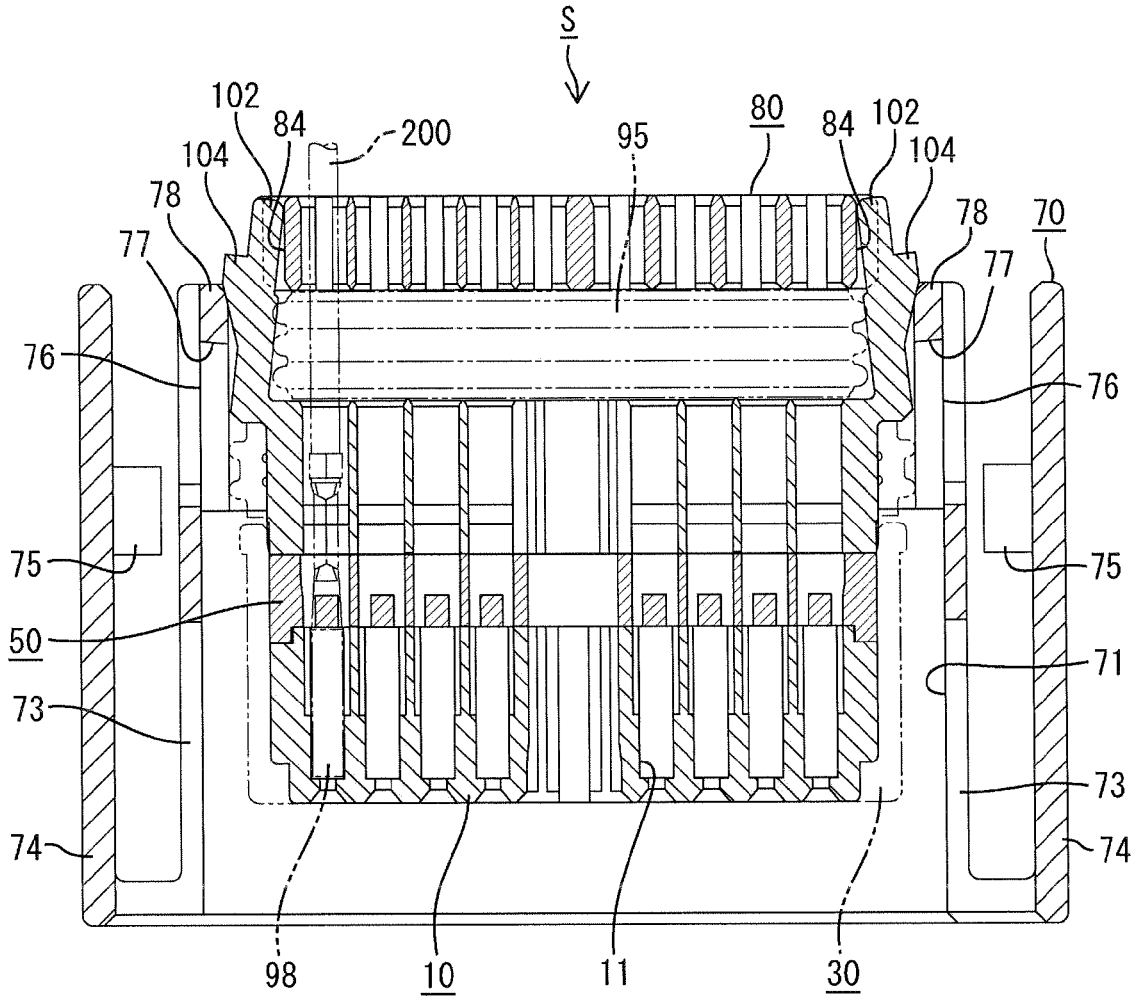
FIG. 10 is a transverse sectional view showing a state in which the housing is disposed midway in inserting the housing into a housing-accommodating chamber of a frame.

A wide rectangular ingress hole 17 is formed at a widthwise central portion of the front surface of the main body 12 of the connector S. The ingress hole 17 extends longitudinally like a tunnel (see FIG. 8) to communicate with the insertion hole 16 and to intersect the insertion hole 16 approximately perpendicularly. The intermediate-stage cavities 11 are disposed at both sides of the ingress hole 17. A long narrow guide groove 17A extends down from a widthwise central portion of a lower edge of the ingress hole 17 (see FIG. 1) and continues over the full longitudinal length of the ingress hole 17. A jig 101 that is slightly narrower than the guide groove 17A can be advanced into the guide groove 17A from the front of the main body 12 for unlocking the retainer 50 (see FIG. 9). The lower half of the ingress hole 17 including the guide groove 17A is disposed between opposed inner edges of the left and right front projections 15A. The mating housing 90 has a hood 91 with a rib 92, as shown in FIG. 8, that can fit into the ingress hole 17 from the front of the main body 12 to guide the fitting of the housings 10, 90 together. Gap-filling projections 15B (see FIG. 24) are formed at positions of both front projections 15A facing the ingress hole 17 for filling the gap between the front projections 15A and the rib 92.

The fit-in concavity 13 is slightly larger than the main body 12 and is made continuous with the main body 12 through a level-different portion 19. A seal ring 96 can be fit on a side surface of the housing main body 12 from the front and is held in position by the level-different portion 19. The thickness of the seal ring 96 is approximately equal to the height of the level-different portion 19.

A seal receiving portion 13A is formed on the front part of the fit-in concavity 13, as shown in FIG. 27, for receiving the rubber seal 95. A rear holder-receiving portion 13B is formed in the fit-in concavity 13 rearward of the seal receiving portion 13A for receiving the rear holder 80. A boundary 13E is provided between an inner surface of the rear holder-receiving portion 13B and an inner surface of the seal receiving portion 13A. The inner surface of the rear holder-receiving portion 13B is disposed outward from the inner surface of the seal receiving portion 13A with the boundary 13E extending therebetween.

Frame-locks 102 (see FIG. 25) are provided on the left and right side walls of the fit-in concavity 13 for preventing the housing 10 from being removed from the housing-accommodating chamber 71 of the frame 70. The frame-locks 102 are deformable between upper and lower slits 103 formed at the rear end of each side wall of the fit-in concavity 13. A free end of each frame-lock 102 is aligned with the rear end of each side wall of the fit-in concavity 13. A frame-locking projection 104 is provided on an outer surface of each frame-lock 102 and is capable of locking a frame to-be-locked portion 76 on an inner surface of the housing-accommodating chamber 71. A front surface of the frame-locking projection 104 is sloped to incline rearward so that the frame-lock 102 has a smooth flexible operation.

A rear holder to-be-locked portion 106 (see FIG. 26) is provided on an upper surface of the fit-in concavity 13 and is elastically deformable between left and right slits 105 formed at the rear end of the upper surface of the fit-in concavity 13. The rear holder to-be-locked portion 106 has a rear holder locking hole 107 for locked engagement with a rear holder-lock 82 of the rear holder 80. An interference concavity 108 is open at the rear end of the upper surface of the fit-in concavity 13 at a position adjacent to the rear holder to-be-locked portion 106 and can receive an interference projection 83 of the rear holder 80. Further forward movement of the rear holder 80 is prevented when the interference projection 83 is fit in the interference concavity 108 and strikes against the front edge of the interference concavity 108.

The terminal fitting 98 is a female terminal fitting and has a square pillar-shaped box 98A at its front and an open barrel 98B at its rear. A mating tab 99 mounted on the mating housing 90 moves into the box 98A to connect the terminal fitting 98 and the mating tab 99 to each other. An end of an electric wire 200 can be connected to the barrel 98B.

The rubber seal 95 is a bulk-type rubber stopper with a plate shape configured to cover the entire rear surface of the main body 12. Wire insertion holes 95A (see FIG. 8) extend through the rubber seal 95 at positions corresponding to the positions of the cavities 11 and are configured respectively for receiving the electric wire 200. Lips 95B are provided on the inner and outer sides of the rubber seal 95. The outer lips 95B closely contact the inner surface of the rear holder-receiving portion 13B in an elastically contracted state, whereas the inner lips 95B closely contact the outer surface of the electric wire 200 in an elastically contracted state. Thus, the gap between the rubber seal 95 and the housing 10 and the gap between the rubber seal 95 and the electric wire 200 achieve a liquid tightly seal.

The rear holder 80 (see FIG. 8) is a plate that covers an entire rear surface of the rubber seal 95 to prevent removal of the rubber seal 95. Wire insertion holes 81 penetrate the rear holder 80 in the thickness direction at positions corresponding to the wire insertion holes 95A for receiving the electric wires 200. The rear holder 80 that has been inserted properly into the rear holder-receiving portion 13B has a rear surface aligned with the rear end of the housing 10 and a front surface that closely contacts the rear surface of the rubber seal 95. The rear holder 80 has a longitudinal length equal to or slightly less than the length of the rubber seal 95. A rear holder-lock 82 projects from a position forward from a widthwise central position of an upper surface of the rear holder 80. An interference projection 83 projects from a rear position of the upper surface of the rear holder 80 spaced from the widthwise central position thereof (see FIG. 15). The front surface of the rear holder-lock 82 has a tapered slope inclining towards its rear end. A flexible operation of the rear holder to-be-locked portion 106 can be guided along this slope.

Figure 11:
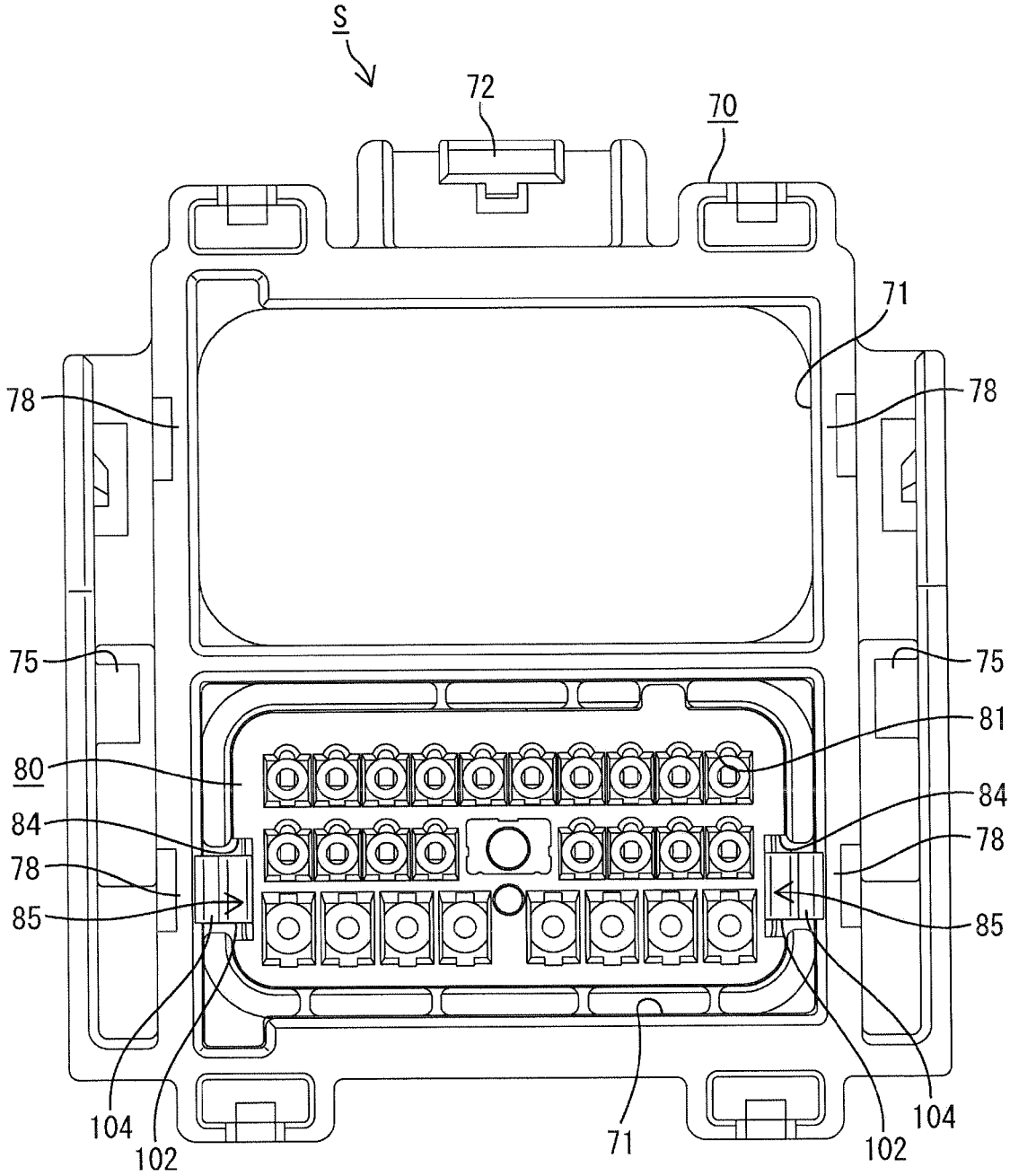
FIG. 11 is a rear view showing the housing inserted partly into the housing-accommodating chamber of the frame.
Figure 12:
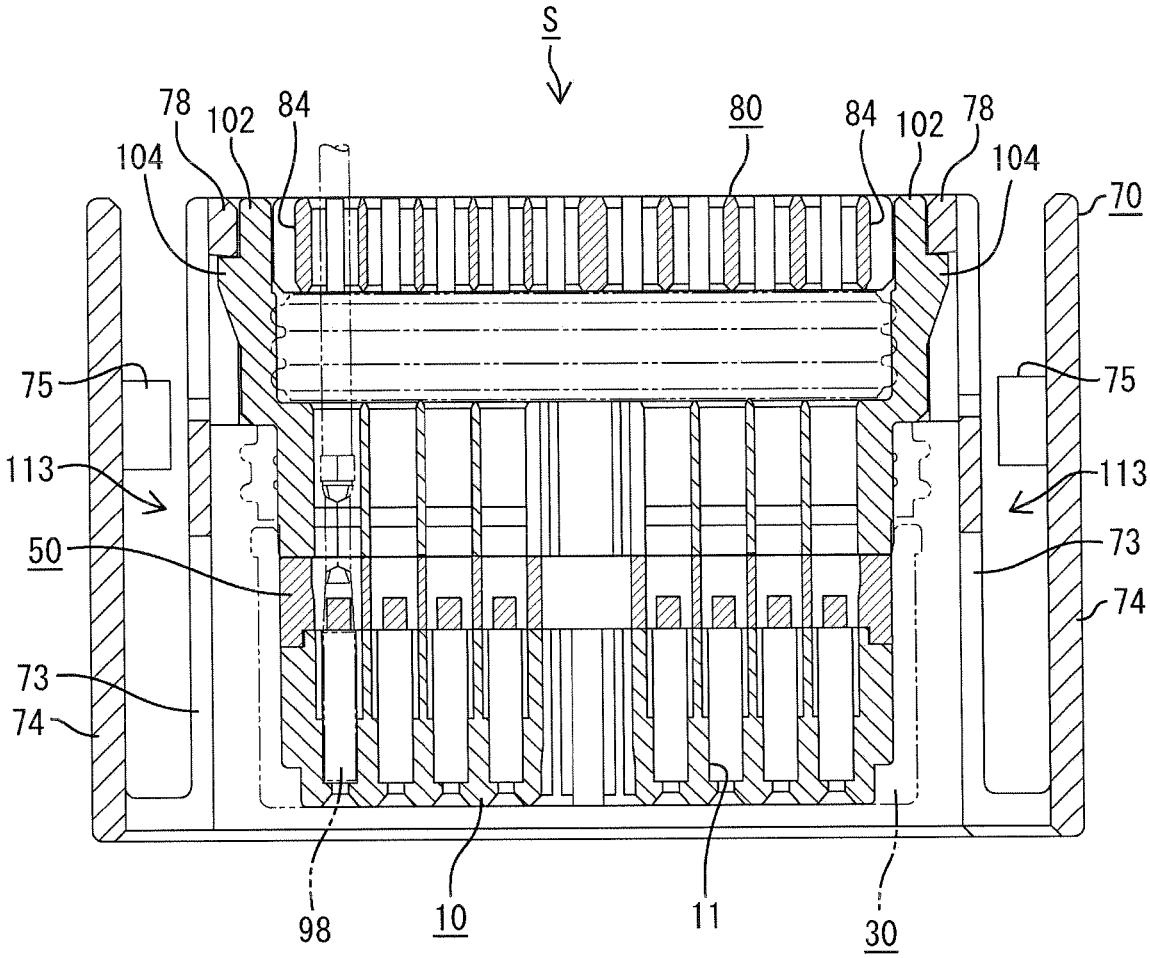
FIG. 12 is a transverse sectional view showing the housing inserted completely into the housing-accommodating chamber of the frame.
Figure 13:
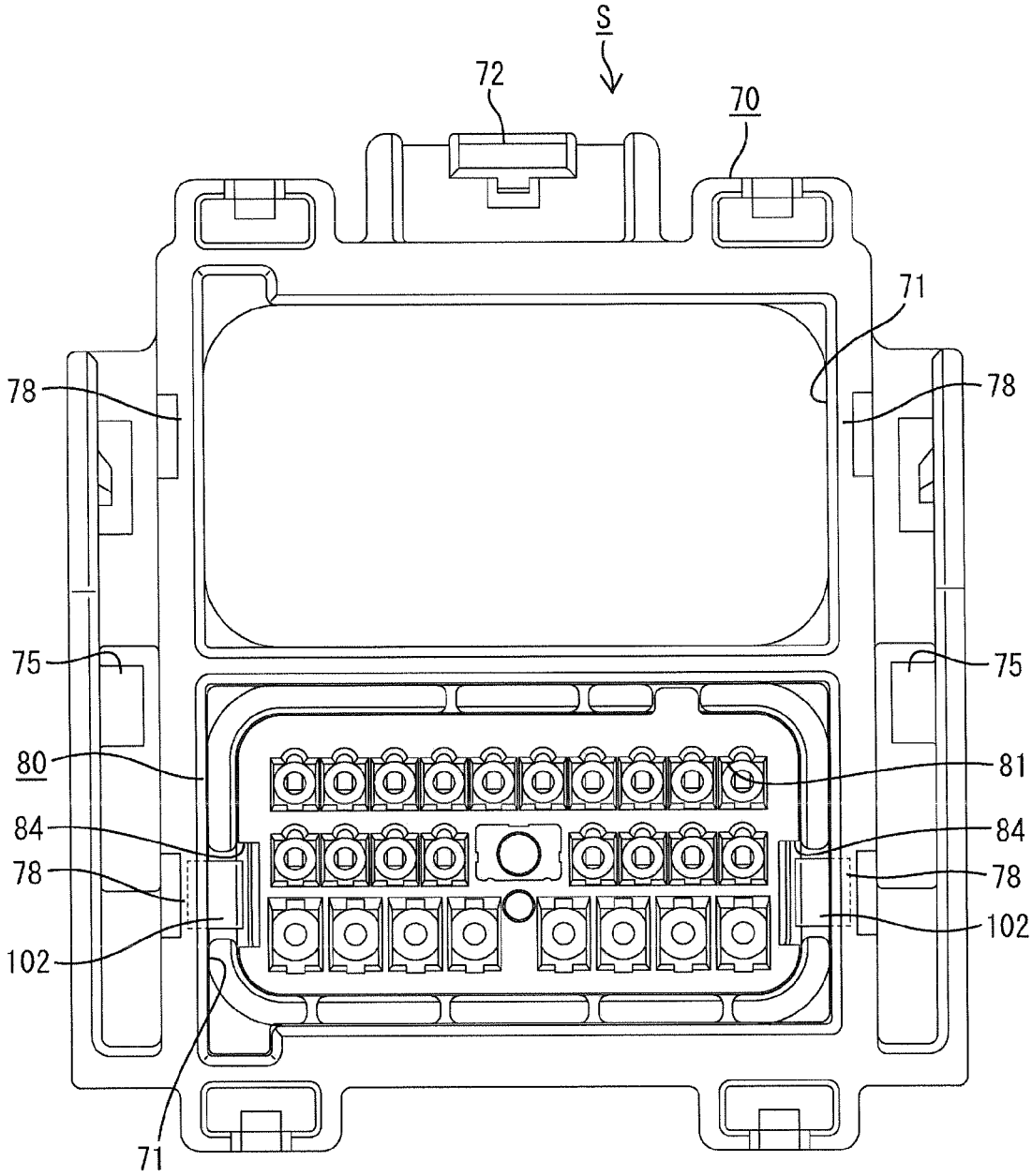
FIG. 13 is a rear view showing the housing inserted completely into the housing-accommodating chamber of the frame.
Figure 14:
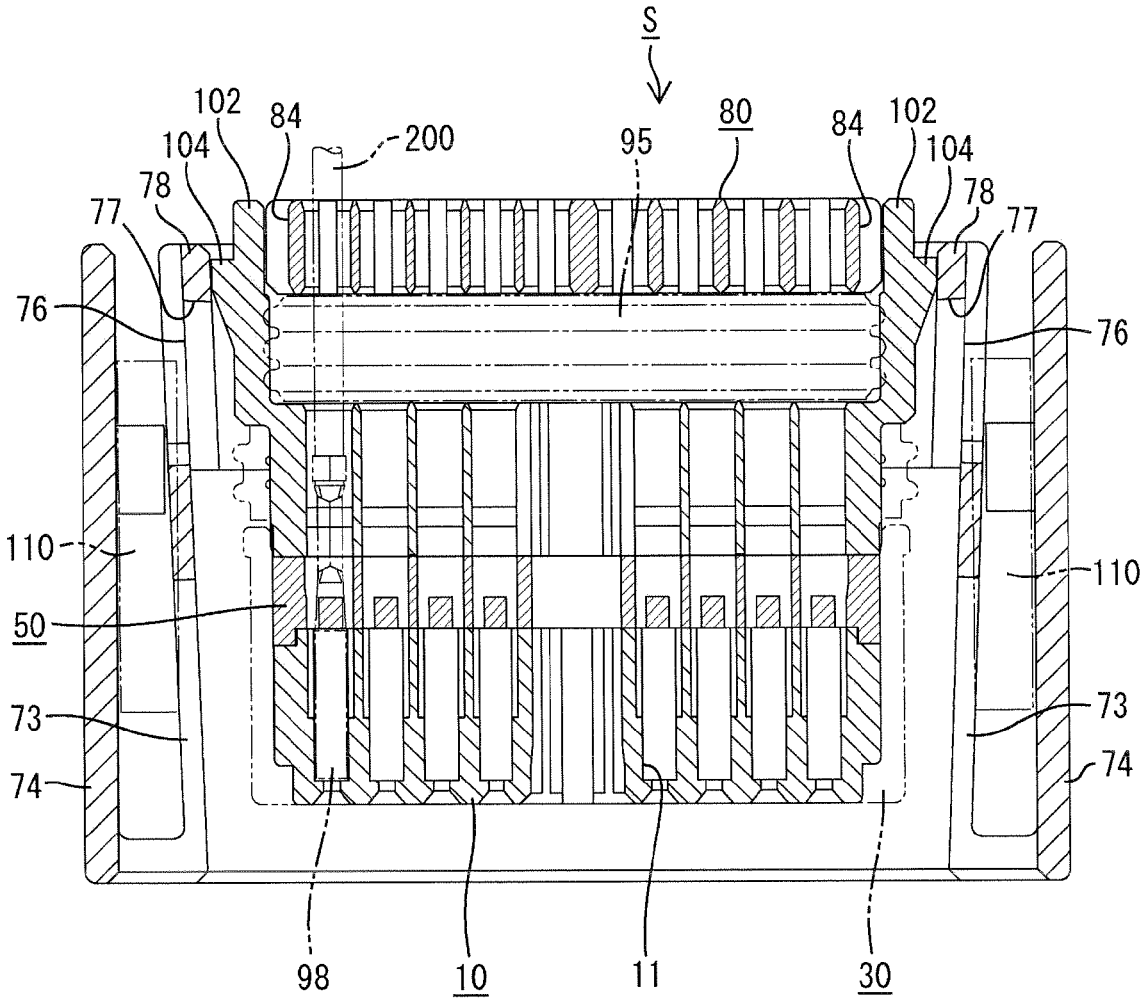
FIG. 14 is a transverse sectional view, different from the transverse sectional view of FIG. 10, which shows the housing inserted partly into the housing-accommodating chamber of the frame.
Figure 15:
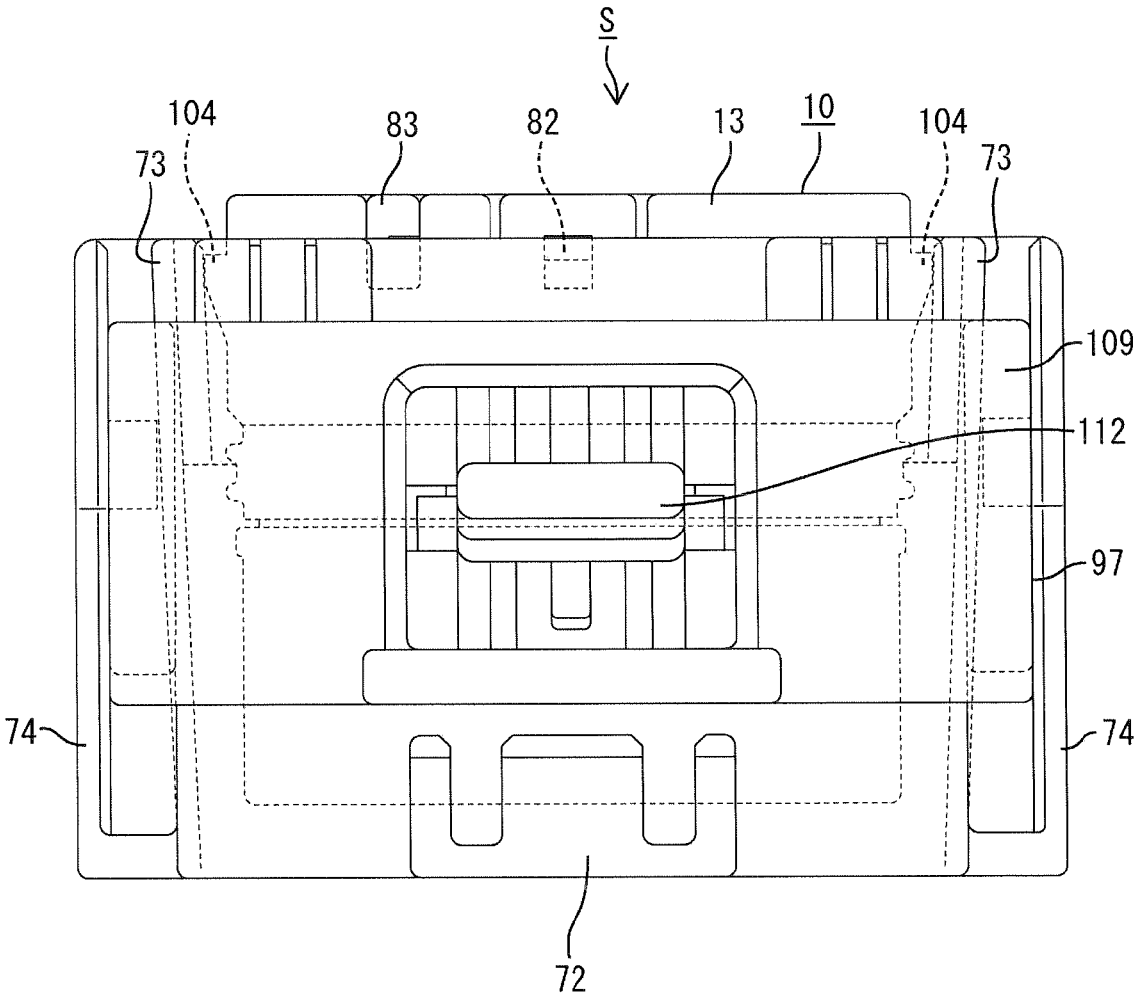
FIG. 15 is a plan view showing the housing inserted midway in the housing-accommodating chamber of the frame.
Figure 16:
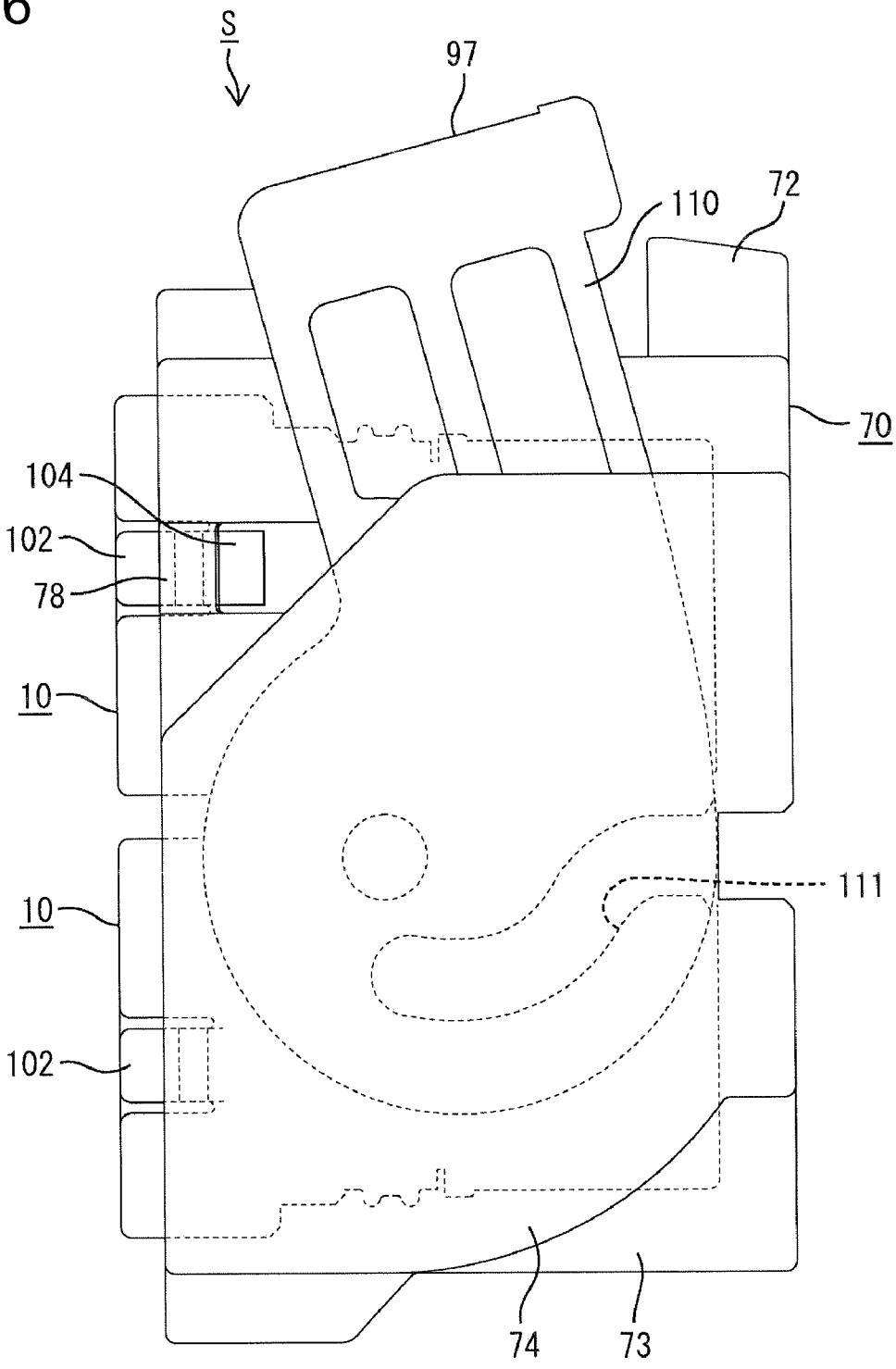
FIG. 16 is a side elevation showing a state in which a lever is held in front of a rotation completion position.
Figure 17:
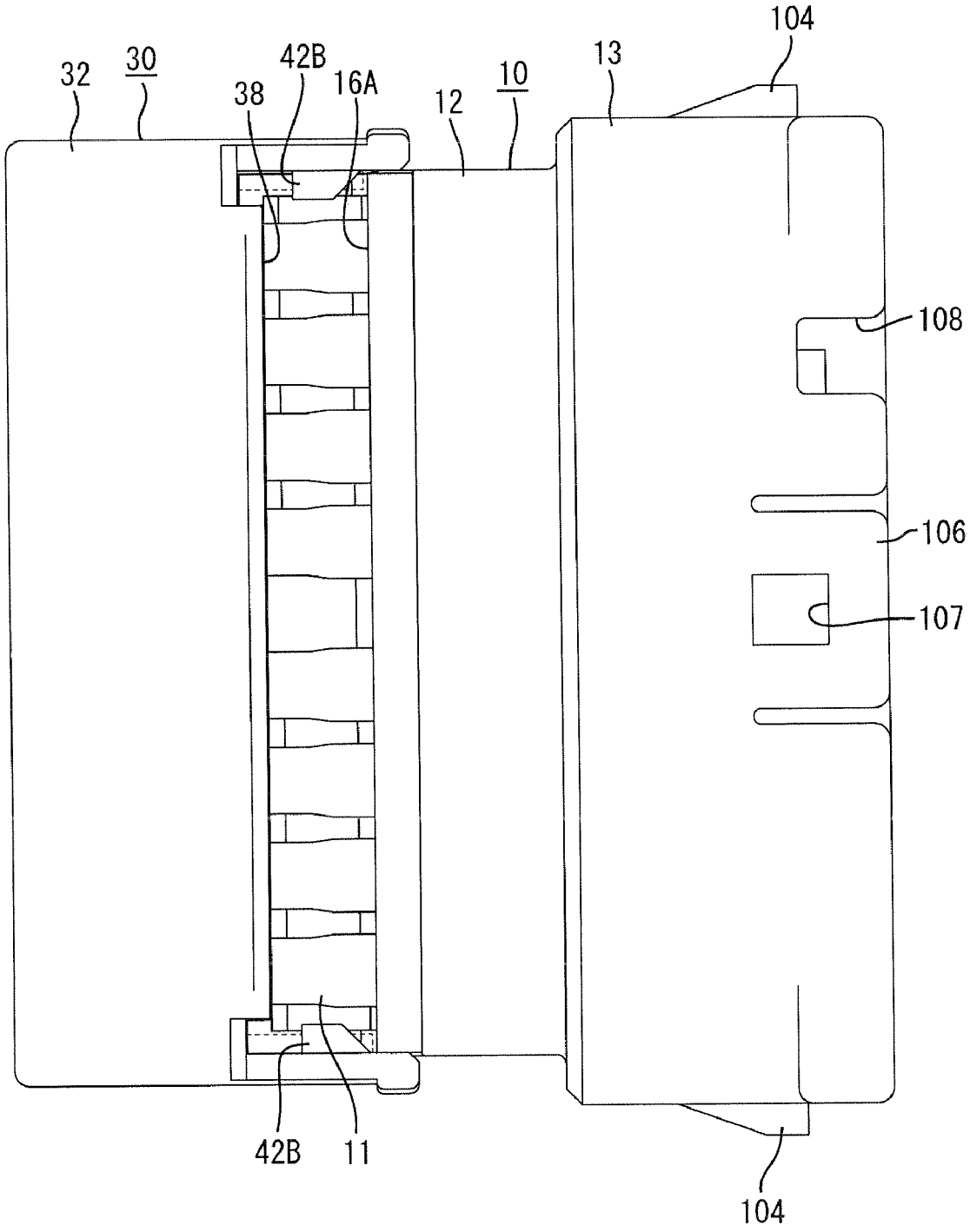
FIG. 17 is a plan view showing a front holder mounted on the housing.

Left and right windows 84 are formed in the left and right side surfaces of the rear holder 80 at positions corresponding to the frame-locks 102 and the frame to-be-locked portions 76, as shown in FIG. 11. The frame-locks 102 and the frame to-be-locked portions 76 are visible from the rear. Each window 84 has an advance space 85 permitting penetration of the frame-lock 102 which elastically deforms inward. Each window 84 allows a flexible operation of the frame-lock 102 to escape and the frame-lock 102 which elastically deforms to interfere with an inner bottom surface of the window 84.

The frame 70 is generally rectangular and has housing-accommodating chambers 71 for accommodating the respective housings 10, as shown in FIGS. 10 through 16. A U-shaped lever 97 is mounted on outer surfaces of the housing-accommodating chamber 71 and straddles the frame 70. The lever 97 has an operation portion 109 (see FIG. 15) that extends widthwise and left and right arms 110 that project from opposite ends of the operation portion 109. The arms 109 are supported rotatably on opposite side surfaces of the frame 70. A cam groove 111 is formed in each arm 110A and engages a cam on the mating housing 90 to display a cam operation between the lever 97 and the mating housing 90 so that the housings 10, 90 can be fit together at a low operational force. An elastically deformable lever lock 112 is provided at a widthwise central part of the operation portion 109 and has a width smaller than the width of the operation portion 109.

A lever to-be-locked portion 72 is provided on an upper surface of the frame 70 at a position corresponding to the lever lock 112. The lever lock 112 elastically locks the lever to-be-locked portion 72 when the lever 97 is rotated to a rotation completion position to prevent rotation of the lever 97. Thus, the lever lock 112 holds the housings 10, 90 in a separation prevention state.

Each side wall of the frame 70 has an inner wall 73, an outer wall 74 and an insertion space 113 between the inner and outer walls 73 and 74 for receiving the corresponding arm 110 of the lever 97. The outer walls 74 of the frame 70 prevent the arms 110 of the lever 97 from deforming away from one another in an opening direction. Supporting shafts 75 project from inner surfaces of the outer walls 74 for supporting the arms 110. A frame to-be-locked portion 76 extends longitudinally on each inner wall 73 of the frame 70. Each frame to-be-locked portion 76 includes a longitudinally extending frame to-be-locked groove 77 and a frame to-be-locked body 78 that vertically spans the frame to-be-locked groove 77 at the rear end of the frame 70. The outer side of the frame to-be-locked body 78 is thinned.

The frame-locking projection 104 interferes with the frame to-be-locked body 78 as the housing 10 is inserted into the housing-accommodating chamber 71. As a result, the frame lock 102 deforms elastically inward. The frame-locking projection 104 fits in the frame to-be-locked groove 77 when the housing 10 is inserted into the housing-accommodating chamber 71 to a predetermined normal depth. Thus, the frame lock 102 elastically returns to its original state, and the frame-locking projection 104 confronts the frame to-be-locked body 78 in a removal direction of the housing 10 to hold the housing 10 in the frame 70 in a removal prevention state.

Figure 18:
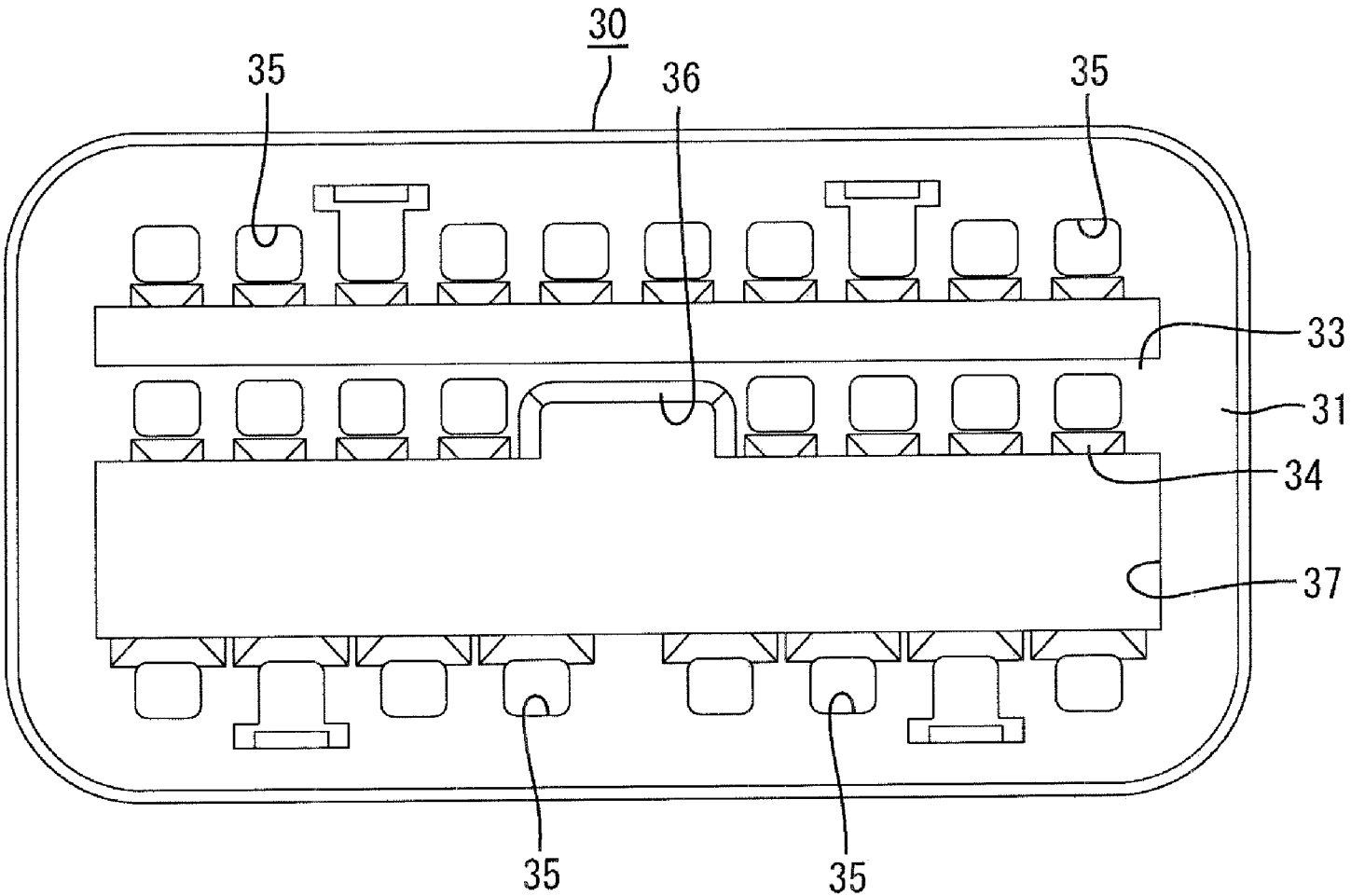
FIG. 18 is a front view of the front holder.
Figure 19:
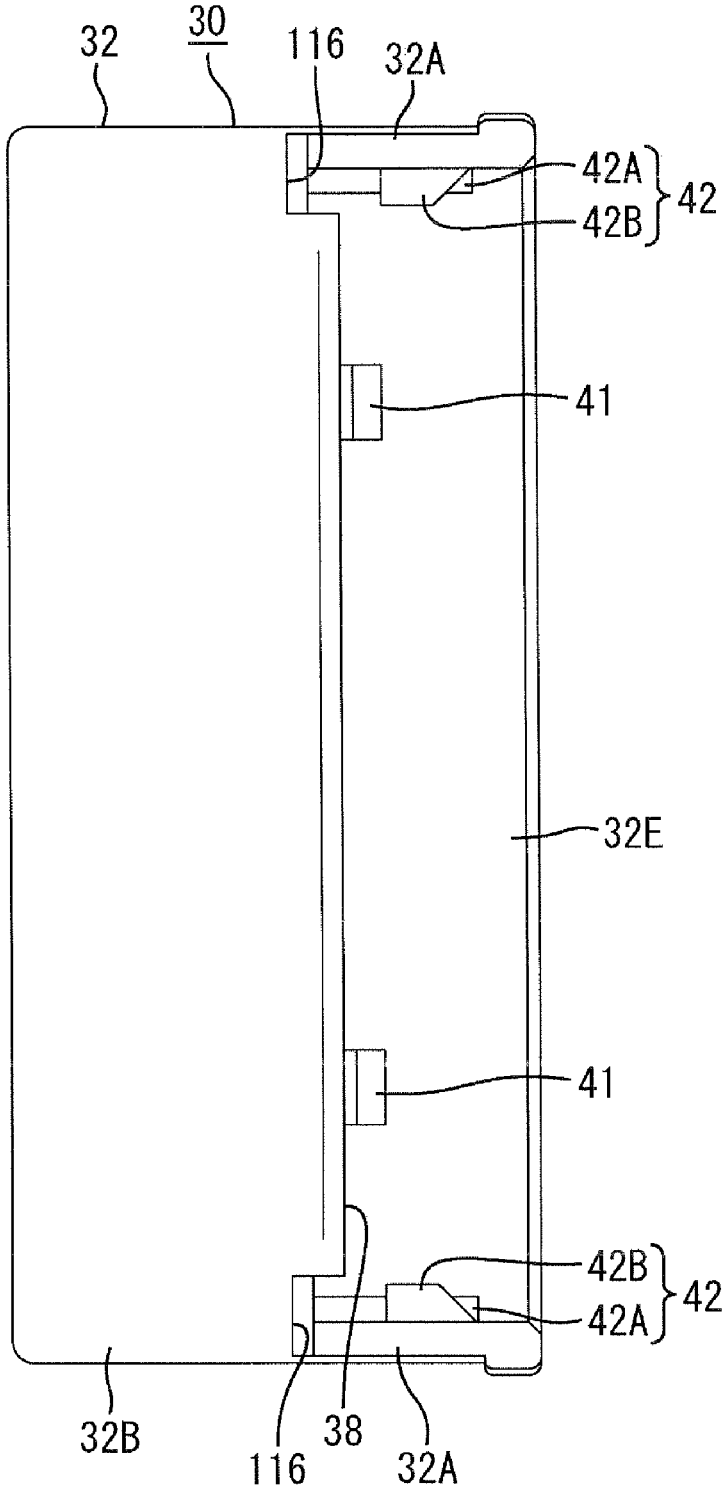
FIG. 19 is a plan view of the front holder.
Figure 20:
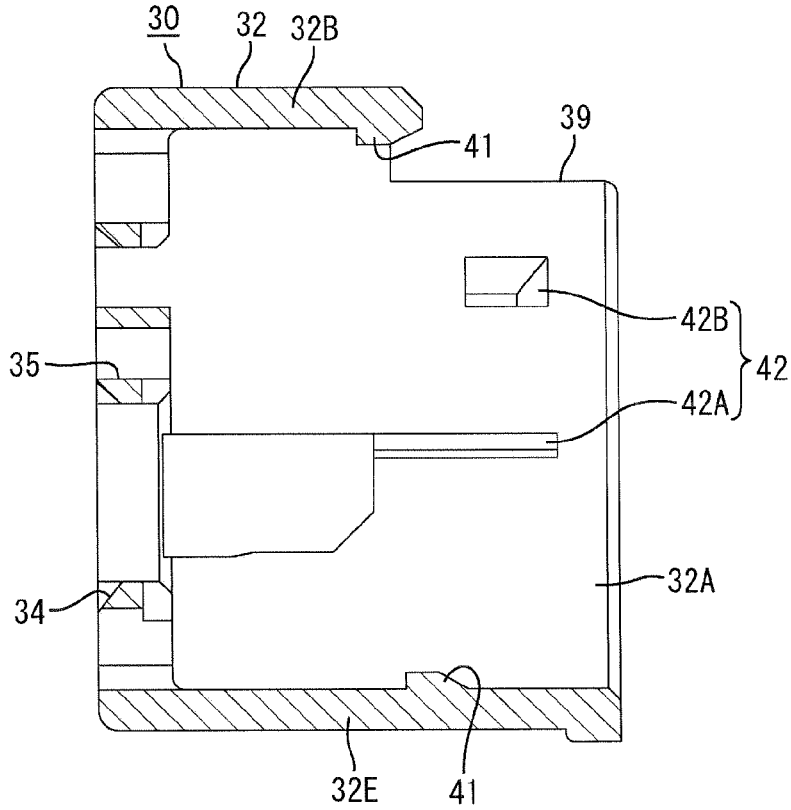
FIG. 20 is a side sectional view of the front holder.

As shown in FIGS. 18 through 20, the front holder 30 is cap-shaped and is configured to fit on the main body 12 of the housing 10. The front holder 30 has a square plate-shaped front wall 31 that covers the front surface of the main body 12 and a quadrangular tubular side wall 32 projects rearward from the outer periphery of the front wall 31. The front wall 31 has a holder-side front surface 33 at a position forward of the lance 14. Tapered auxiliary guide edges 34 are provided on the holder-side front surface portion 33 and cooperate with the housing-side front surface 15 to define guide ports 100 for the tabs 99. A rectangular jig insertion port 35 also is provided on the holder-side front surface 33 and can receive a jig for unlocking the terminal fitting 98. The jig insertion port 35 is adjacent to the rear holder to-be-locked portion 34 and faces a flexing space of the lance 14. The rear holder to-be-locked portion 34 and the jig insertion port 35 are disposed in correspondence with the positions of the cavities 11. An auxiliary ingress open edge 36 is formed on the front wall 31 continuous with the housing-side front surface 15 to form an opening of the ingress hole 17 and a wide rectangular enlarged opening 37 is provided below the auxiliary ingress open edge 36. The front-surface projection 15A of the main body 12 can be fit into the enlarged opening 37.

The side wall 32 of the front holder 30 has left and right side surfaces 32A that cover the left and right side surfaces of the main body 12, a lower panel 32E that covering the lower surface of the main body 12, and an upper panel 32B that covers the upper surface of the main body 12. Rear ends of the side panels 32A and the lower panel 32E are disposed immediately forward from the front end of the seal ring 96 and are capable of covering approximately all of the three surfaces of the main body 12 forward from the seal ring 96. A rear end of the upper panel 32B is disposed immediately forward from the insertion port 16A of the insertion hole 16 and is capable of covering approximately all of the upper surface of the main body 12 forward from the insertion port 16A. Therefore the insertion port 16A of the insertion hole 16 is not closed by the upper panel 32B. However, portions of the opening of the insertion hole 16 disposed at both the left and right sides of the insertion port 16A are closed by both side panels 32A from the outer side.

A holder-side insertion port 38 (see FIG. 17) opens rearwardly at a position on the side wall 32 of the front holder 30 rearward of the rear end of the upper panel 32B and between the upper ends of both side panels 32A. Chin-shaped steps 39 are formed at the upper ends of both side panels 32A by the formation of the holder-side insertion port 38. The front end of the holder-side insertion port 38 is longitudinally coincident with the front end of the insertion port 16A when the front holder 30 is mounted on the housing main body 12 in a normal state so that the holder-side insertion port 38 communicates with the insertion port 16A.

A claw-shaped front holder lock 41 faces inward on each of the upper and lower panels 32B and 32E of the front holder 30. The front holder lock 41 on the upper panel 32B is at a position confronting the holder-side insertion port 38, with the front end thereof being disposed at the side of the holder-side insertion port 38, whereas the front holder lock 41 on the lower panel 32E is disposed at the free rear end thereof. The front holder lock 41 slides in contact with the side surface of the main body 12 of the housing 10 while mounting the front holder 30 on the main body 12 so that the side wall 32 expands slightly outward. The front holder lock 41 fits in a front holder to-be-locked portion 18 when the front holder 30 is mounted on the main body 12 in a normal state so that the front holder lock 41 and the front holder to-be-locked portion 18 are locked together. As a result, the side wall 32 is restored to its original state from the expanded state. Thereby the front holder 30 is held in the connector housing 10 in a removal prevention state.

Retainer to-be-locked portions 42 are provided on the inner surfaces of the side panels 32A of the front holder 30 and can be locked to the retainer locks 54. Each retainer to-be-locked portion 42 is disposed at a vertically central position of the front holder 30 and includes a longitudinally long and narrow small retainer to-be-locked projection 42A and a large retainer to-be-locked projection 42B spaced upward from the small retainer to-be-locked projection 42A at a certain interval. The small and large retainer to-be-locked projections 42A and 42B are triangular in a front view. The retainer 50 is movable between the small and large retainer to-be-locked projections 42A and 42B. The projected amount of the large retainer to-be-locked projection 42B is larger than the projected amount of the small retainer to-be-locked projection 42A to define a means for preventing the retainer 50 from separating from the front holder 30 when the retainer 50 is at the temporary locking position. The small retainer to-be-locked projection 42A is capable of interfering with the retainer 50 when the retainer 50 is moving and defines a means for preventing the retainer 50 from moving in a return direction when the retainer 50 is inserted into the insertion hole 16 in a predetermined normal depth. Regions of the inner surfaces of both side panels 32A forward from the small retainer to-be-locked projection 42A is thinned to allow the region to be flexible. The small retainer to-be-locked projection 42A and the front holder lock 41 longitudinally overlap each other and the large retainer to-be-locked projection 42B is forward from the front holder lock 41.

Figure 21:
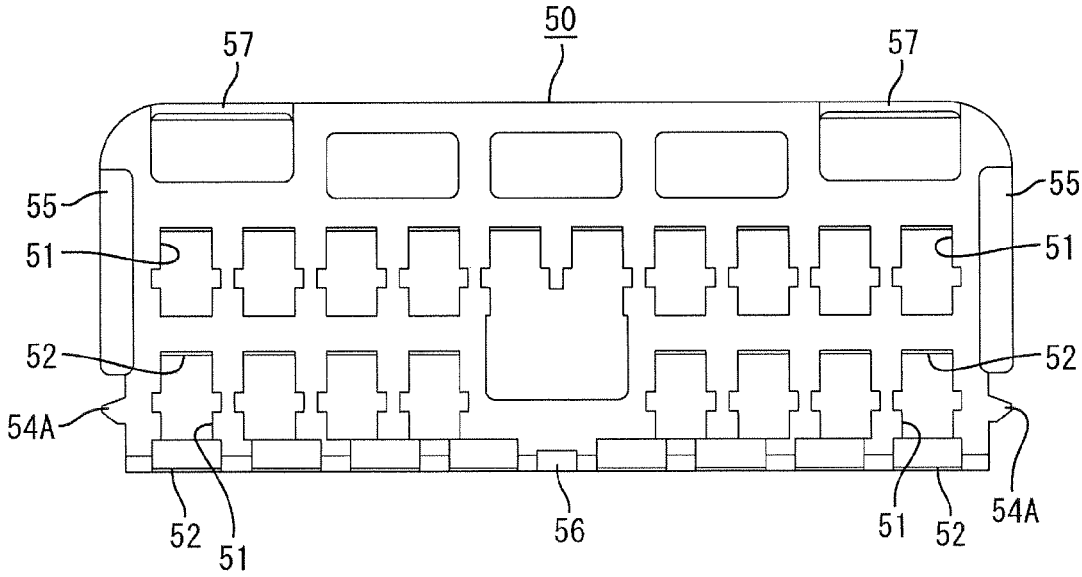
FIG. 21 is a front view of the retainer.
Figure 22:
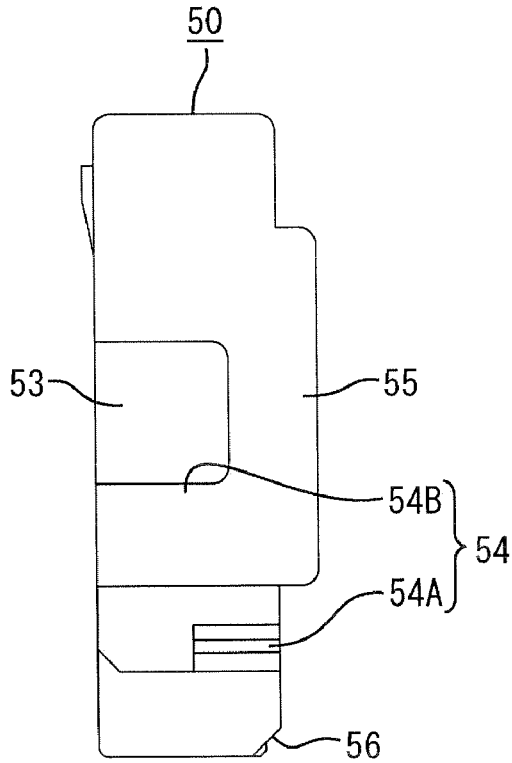
FIG. 22 is a side elevational view of the retainer.
Figure 23:
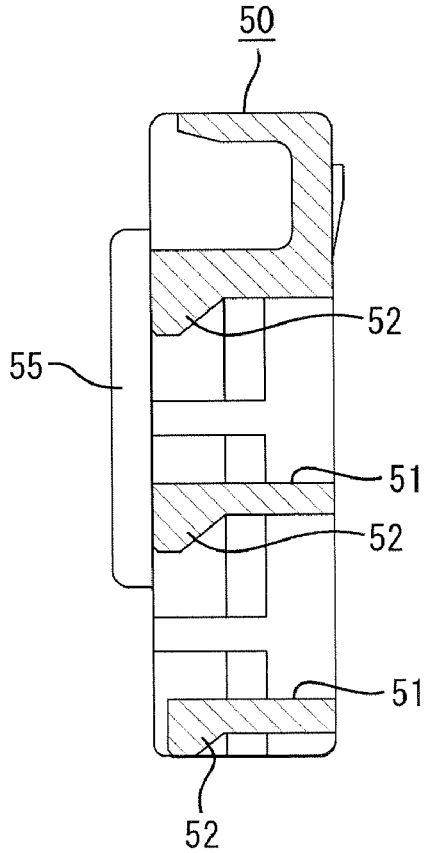
FIG. 23 is a side sectional view of the retainer.

The retainer 50 defines a lattice-shaped plate, as shown in FIGS. 21 through 23, and can be inserted into the insertion hole 16 of the main body 12 of the housing 10 in a vertical posture for movement between a temporary locking position and a main locking position. The retainer 50 has a width almost equal to the entire width of the main body 12 and side surfaces of the retainer 50 can slide on the inner surfaces of both side panels 32A of the front holder 30. Windows 51 are formed in the retainer 50 at positions corresponding to the positions of the upper-stage and intermediate-stage cavities 11. Locking projections 52 are formed on an inner surface of each window 51 and at a lower edge of the retainer 50 at positions corresponding to the cavities 11. Escape grooves 53 are formed on both side surfaces of the retainer 50 for receiving retainer to-be-locked portions 42. A retainer lock 54 is provided inside the escape groove 53. The retainer lock 54 is constructed of a small retainer-locking projection 54A disposed at a lower position and a large retainer-locking projection 54B disposed at an upper position. The small retainer-locking projection 54A is triangular in a front view, whereas the large retainer-locking projection 54B is quadrangular in a front view. The large retainer-locking projection 54B is larger than the small retainer-locking projection 54A. The large and small retainer-locking projections 54B and 54A are offset in the longitudinal direction so that the large retainer-locking projection 54B is rearward from the small retainer-locking projection 54A.

The large retainer-locking projection 54B confronts the large retainer to-be-locked projection 42B in the removal direction thereof when the retainer 50 is at the temporary locking position to prevent removal of the retainer 50. The small retainer-locking projection 54A confronts the small retainer to-be-locked projection 42A in a pressing direction to restrict movement of the retainer 50 to the main locking position (see FIG. 3). At this time, the retainer 50 projects up from the upper panel 32B of the front holder 30. The small retainer-locking projection 54A interferes with the small retainer to-be-locked projection 42A in the direction in which both strike against each other as the retainer 50 is moved from the temporary locking position to the main locking position. As a result, corresponding portions of both side panels 32A of the front holder 30 expand outward (see FIG. 4). The small retainer-locking projection 54A rides across the small retainer to-be-locked smaller projection 42A when the retainer 50 is at the main locking position. As a result, both side surface panels 32A are restored to their original state from the expanded state, and the small retainer-locking projection 54A is opposed to the small retainer to-be-locked projection 42A in the removal direction of the retainer 50 to prevent a return of the retainer 50 to the temporary locking position (see FIG. 5). At this time, the end surface of the retainer 50 is located almost at the same level as the outer surface of the upper panel 32B to close the holder-side insertion port 38.

Left and right retainer guide ribs 55 (see FIG. 21, 22, 23) extend vertically at both widthwise ends of the front surface of the retainer 50 and are continuous with the large retainer-locking projections 54B. The retainer guide ribs 55 fit in corresponding retainer guide rib-receiving portions 115 of the main body 12 of the housing 10 and in corresponding retainer guide rib-receiving concavities 116 of the front holder 30 when the retainer 50 moves to guide the movement of the retainer 50.

A receiving portion 56 is provided at a widthwise central position of the lower end of the front surface of the retainer 50 (see FIG. 9) and faces the guide groove 17A of the ingress hole 17 when the retainer 50 is at the main locking position. The receiving portion 56 is a tapered cut-out that it is capable of engaging the jig 101 that advances into the guide groove 17. The tip of the jig 101 wrenches the guide groove 17A with the tip of the jig 101 to move the retainer 50 towards the temporary locking position. Left and right auxiliary receiving portions 57 (see FIG. 21) are cut out on the upper surface of the retainer 50. The auxiliary receiving portion 57 is wrenched with the jig 101 operated from above to move the retainer 50 to the temporary locking position.

The connector S is assembled by fitting the seal ring 96 on the housing main body 12 from the front end at a position forward from the level-different portion 19. The front holder 30 then is placed on the main body 12 from the front end. The front holder lock 41 is fit elastically in the front holder to-be-locked portion 18 of the main body 12 when the front holder 30 reaches a predetermined normal mounting position to fix the front holder 30 to the housing 10 in the removal prevention state. At this time, the front wall 33 of the front holder 30 and the front surface 15 of the housing 10 are fit on each other in a convex and concave relationship to define the front surface of the connector S. Additionally, the guide port 100 and the ingress hole 17 open in the shape of closed loops at different positions (see FIG. 1).

The retainer 50 is inserted from the holder-side insertion port 38 of the front holder 30 through the insertion port 16A of the main body 12 and into the insertion hole 16. The retainer guide rib 55 fits in the retainer guide rib-receiving portion 115 to guide the retainer 50 in the vertical direction with the side panels 32A of the front holder 30 preventing a free movement of the retainer 50 in the width direction. The retainer locks 54 elastically lock the retainer to-be-locked portions 42 when the retainer 50 reaches the temporary locking position to prevent removal of the retainer 50 and to prevent movement of the retainer 50 towards the main locking position (see FIGS. 2, 3, and 6). In this state, the locking projection 52 of the retainer 50 is rearward from the root of the lance 14 and is prevented from advancing into the cavities 11. Thus, the terminal fittings 98 can be inserted into the cavities 11. The retainer 50 might not be pressed completely to the temporary locking position. However, in this situation, interference between the large retainer to-be-locked projection 42B and the large retainer-locking projection 54B or interference between the large retainer to-be-locked projection 42B and the small retainer-locking projection 54A will cause the side panels 32A of the front holder 30 to expand outward. Thus the insufficient insertion of the retainer 50 can be detected from the outside.

The terminal fittings 98 are inserted into the cavities 11 from the rear while the retainer 50 is at the temporary locking position. The holder-side front surface 33 and the housing-side front surface 15 prevent forward movement of the terminal fittings 98 in the cavities 11 beyond the normal state, and the lances 14 achieve primary locking of the terminal fittings 98 at the normal state. The retainer 50 is pressed into the main locking position after all of the terminal fittings 98 have been inserted into the respective cavities 11. As a result, the retainer lock 54 is locked elastically to the retainer to-be-locked portion 42 to prevent the retainer 50 from returning to the main locking position is prevented. Additionally, the locking projections 52 advance into the cavities 11 and confronts the rear end of the box 98A of each terminal fitting 98 to achieve secondary locking of the terminal fittings 98 in the removal prevention state (see FIGS. 5, 7). The retainer 50 might be stopped midway before it reaches the main locking position. However, in this state, interference between the small retainer-locking projections 54A and the small retainer to-be-locked projections 42*a* cause the corresponding portions of the side panels 32A of the front holder 30 to expand outward. This incomplete insertion of the retainer 50 to the main locking position can be detected from the outside (see FIG. 4).

The rubber seal 95 is inserted into the rear holder-receiving portion 13B of the fit-in concavity 13 so that the front surface of the rubber seal 95 is pressed against the rear surface of the main body 12. As a result, the outer surface of the rubber seal 95 closely contacts the inner surface of the rear holder-receiving portion 13B and seals the gap therebetween. Further the inner surface of the rubber seal 95 at the wire insertion hole 95A closely contacts the peripheral surface of the electric wire 200 to seal the gaps therebetween. The rear holder 80 then is inserted into the rear holder-receiving portion 13B of the fit-in concavity 13 from the rear. Interference between the interference projection 83 and the front edge of the interference concavity 108 stops the forward movement of the rear holder 80 into the rear holder-receiving portion 13B at the normal state. Further at this time, the rear holder lock 82 is fit in and locks to the rear holder locking hole 107 of the rear holder to-be-locked portion 106. Thus, the rear holder 80 is fixed to the housing 10 in the removal prevention state and prevents removal of the rubber seal 95. The frame lock 102 and the frame to-be-locked portion 76 are disposed sequentially in the outside of the window 84 of the rear holder 80 when the rear holder 80 is inserted into the rear holder-receiving portion 13B in the normal state. That state is visible from the rear side.

The retainer 50 must be moved from the main locking position to the temporary locking position when it is necessary to remove the terminal fittings 98 from the cavities 11 for maintenance or the like. Thus, the jig 101 is inserted into the ingress hole 17 from the front of the main body 12 and the tip of the jig 101 is moved into contact with the receiving portion 56 at the inner side of the guide groove 17A (see FIG. 9). The jig 101 is operated in the direction shown with an arrow in FIG. 9 so that the tip of the jig 101 lifts up the receiving portion 56. As a result, the retainer 50 is moved up and held again at the temporary locking position. The surface of the guide groove 17 efficiently functions as a pedestal while operating the jig 101. The jig 101 can be inserted into the ingress hole 17 and can be operated by engaging the tip of the jig 101 with the auxiliary receiving portion 57 of the retainer 50. Alternatively, the jig 101 can be inserted into the ingress hole 17 from the open side of the holder-side insertion port 38 by utilizing the construction in which the holder-side insertion port 38 is open at the rear end of the side wall 32 of the front holder 30.

The assembled housing 10 is inserted into the housing-accommodating chamber 71 of the frame 70 from the rear. Interference between the frame lock 102 and the frame to-be-locked portion 76 causes the frame lock 102 to deform elastically inward during insertion of the housing 10 into the housing-accommodating chamber 71. The free rear end of the frame lock 102 then advances into the window 84 (see FIG.

10). Further, the frame to-be-locked portion 76 is pressed by the frame lock 102 and elastically deforms outward. Consequently each inner wall 73 of the frame 70 expands outward and is capable of overlapping with the rotational region of the arm 110 of the lever 97 (see FIGS. 14, 15).

The frame-locking projection 104 of the frame lock 102 fits in the frame to-be-locked groove 77 when the housing 10 is inserted into the housing-accommodating chamber 71 in the normal state. As a result, the frame lock 102 elastically returns to its original state, and the frame-locking projection 104 confronts the frame to-be-locked body 78 in the removal direction of the housing 10. Thus, the housing 10 is fixed inside the frame 70 (see FIG. 12). The state where the frame lock 102 has returned to its original state is visible through the window 84.

The frame lock 102 advances into the window 84 when the housing 10 is inserted to the normal state in the housing-accommodating chamber 71 of the frame 70. This state is visible from the rear. Thus, it is possible to detect that the housing 10 has been inserted incompletely into the housing-accommodating chamber 71 (see FIG. 11). On the other hand, the housing 10 might not be inserted completely into the housing-accommodating chamber 71 of the frame 70. This state might not be inspected visibly. However, interference between the frame lock 102 and the frame to-be-locked portion 76 causes the outer surface of the inner wall 73 to expand outwardly if the housing 10 is inserted incompletely into the housing accommodating chamber 71. The arm 110 of the lever 97 interferes with outwardly expanded inner wall 73 when the lever 97 is rotated in an attempt to fit the housing 10 on the mating housing 90 and operation of the lever 97 is prevented. Therefore it is possible to detect incomplete insertion of the housing 10 into the housing-accommodating chamber 71 (see FIG. 14). The housing 10 then can be inserted more deeply into the housing-accommodating chamber 71.

The mating housing 90 is inserted into the frame 70 and is fit lightly on the housing 10. The lever 97 then is rotated to the rotation completion position. At this time, the rib 92 of the mating housing 90 advances into the ingress hole 17 of the housing 10 from the front to guide the fitting of the mating housing 90 on the housing 10. Therefore, rotation of the lever 97 prevents the housings 10, 90 from being fit forcibly together.

All of the opening of the insertion hole 16 of the housing 10 except the insertion port 16A is closed by the side wall 32 of the front holder 30 when the front holder 30 is mounted on the housing 10. Thus, the side surfaces of the retainer 50 can slide on the inner surfaces of the side wall 32 so that the front holder 30 guides the movement of the retainer 50. Consequently it is unnecessary to provide the housing 10 with structure for guiding the movement of the retainer 50 and the construction of the housing 10 can be simplified.

The retainer to-be-locked portion 42 is provided on the front holder 30 and need not be provided on the housing 10. Thus it is possible to simplify the construction of the housing 10.

The retainer lock 54 incompletely locks the retainer to-be-locked portion 42 when the retainer 50 is accommodated in the insertion hole 16 of the housing 10 in an incomplete state. As a result, the corresponding portions of the side panels 32A of the front holder 30 expand outward. Thus, incomplete insertion of the retainer 50 can be detected by watching or touching this state from the outside.

The longitudinal lengths of the housing 10 and the front holder 30 are shortened because the holder-side ingress hole 38 of the front holder 30 is open at the rear end of the side wall 32. In this case, it is possible to move the retainer 50 from the main locking position to the temporary locking position (direction in which the retainer 50 separates from the housing 10) by inserting the jig 101 into the holder-side ingress hole 38 from the open side thereof.

The jig 101 can be inserted into the ingress hole 17 of the housing 10 from the front and can wrench the receiving portion 56 of the retainer 50 to move the retainer 50 from the main locking position to the temporary locking position. Therefore the ingress hole 17 is used to receive the rib 92 of the mating housing 90 and also is used as a hole for receiving the jig 101. Accordingly, the construction of the housing 10 is simplified. The receiving portion 56 of the retainer 50 is accommodated inside the housing 10 and cannot be damaged by foreign matter.

The ingress hole 17 of the main body 12 is disposed at the widthwise central portion of the housing 10. Thus, the retainer 50 can be moved in a favorable balance when the receiving portion 56 of the retainer 50 is wrenched with the jig 101.

The tip of the jig 101 can engage the receiving portion 56 of the retainer 50 by moving the jig 101 along the guide groove 17A. Thus the operability is good.

It is possible to detect whether the housing 10 has been inserted into the frame 70 in the normal state by detecting the state of the frame lock 102 from the rear through the window 84 of the rear holder 80. Therefore it is possible to prevent the housing 10 from being held inside the frame 70 in the incomplete state. In this case, a detection jig (not shown in the drawings) may be inserted into the window 84 of the rear holder 80 to detect whether the detection jig contacts the frame lock 102. Thus, it is possible to detect the state of the frame lock 102.

The rear of the frame lock 102 advances into the window 84 when the frame lock 102 deforms elastically. This flexible state of the frame lock 102 can be detected easily at a front end without looking deep into the window 84. Additionally, the frame lock 102 and the rear holder 80 overlap each other longitudinally so that the longitudinal length of the entire connector S is small.

Figure 28:
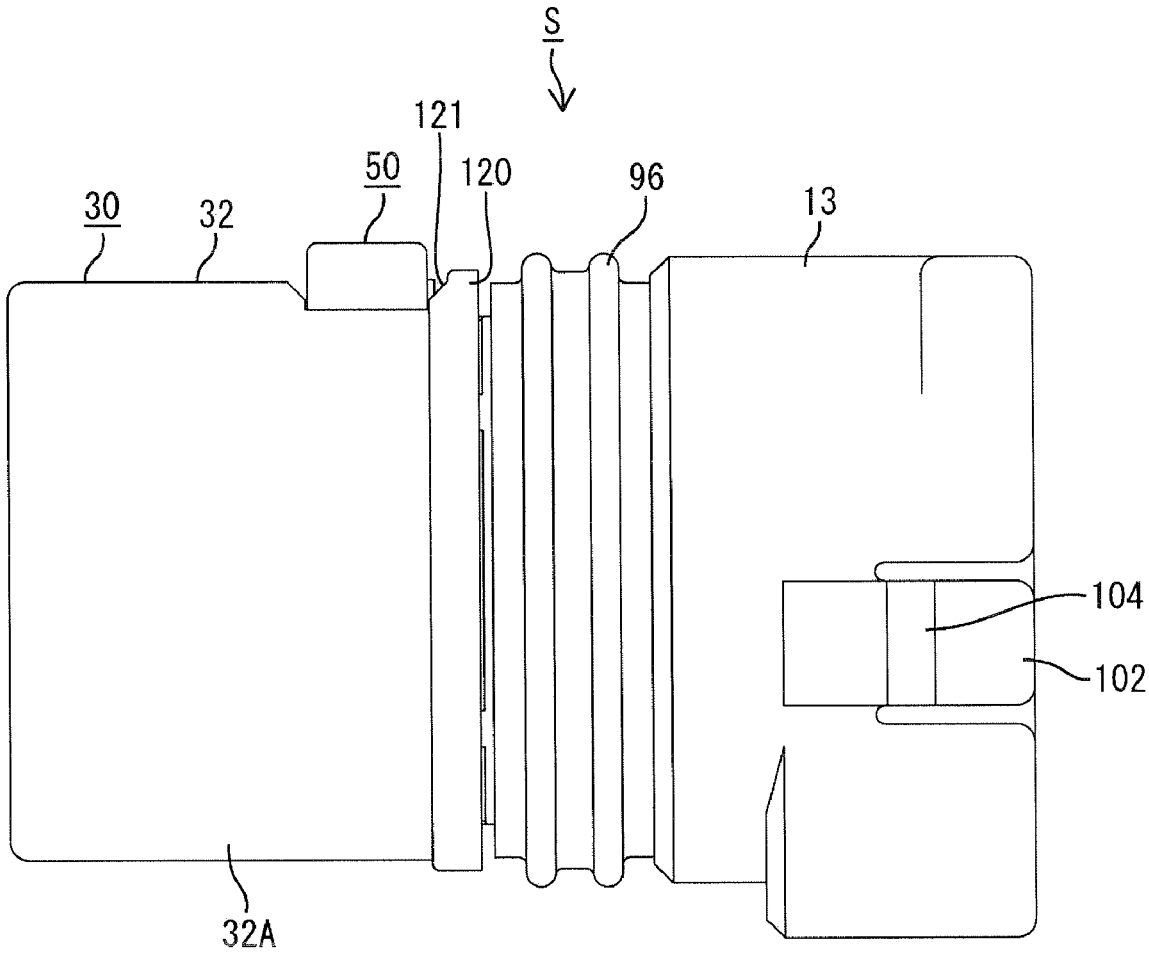
FIG. 28 is a front view showing a front holder mounted on the housing in a second embodiment of the invention.
Figure 29:
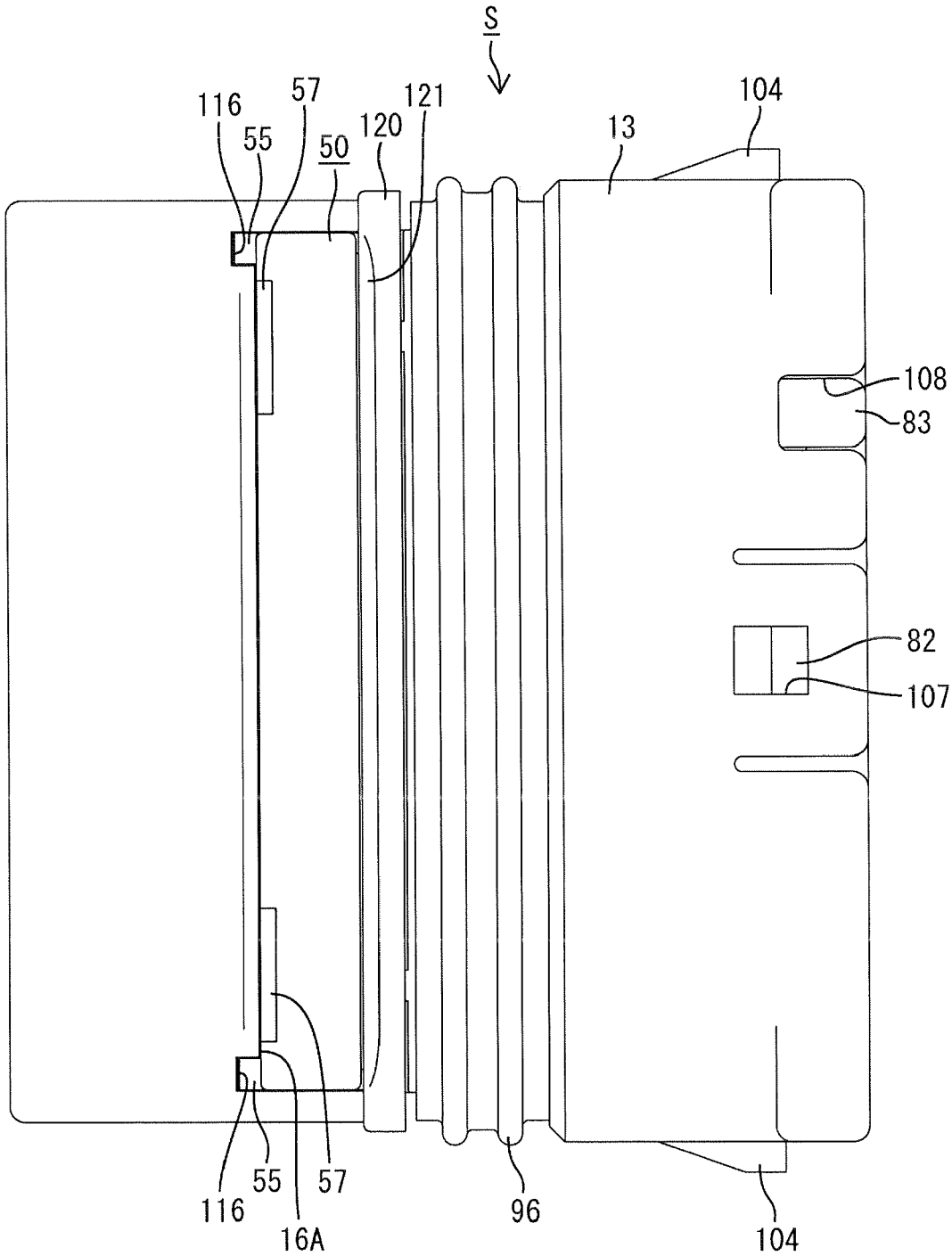
FIG. 29 is a plan view showing the front holder mounted on the housing.
Figure 30:
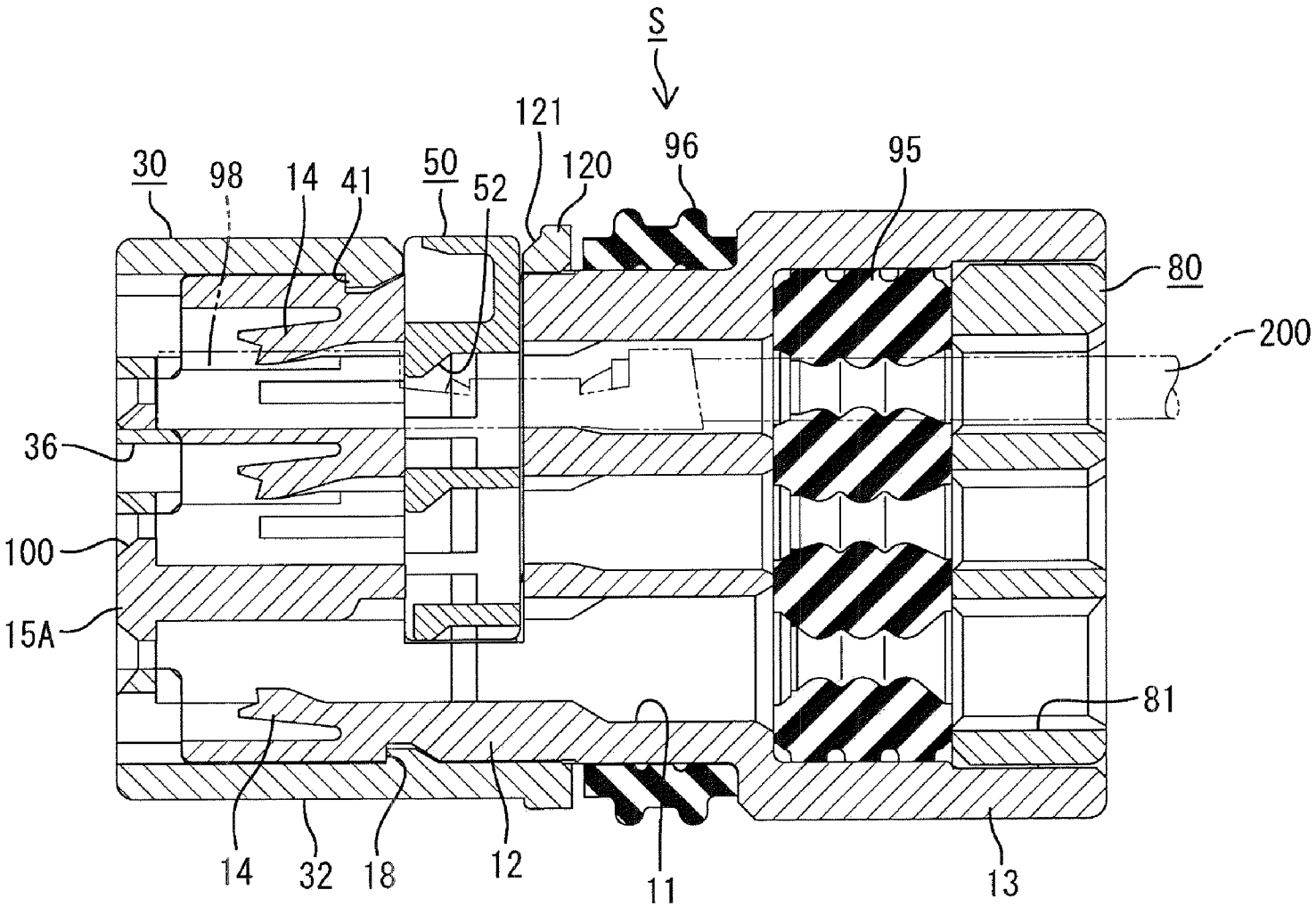
FIG. 30 is a vertical sectional view showing the front holder mounted on the housing and the retainer held at a main locking position.

The second embodiment of the invention is described below with reference to FIGS. 28 through 30. The front holder 30 of the second embodiment is a little different from that of the first embodiment. However, other elements of the second embodiment are similar to those of the first embodiment. Therefore, parts of the second embodiment that are the same as those of the first embodiment are denoted by the same reference numerals as in the first embodiment, and description thereof is omitted herein.

A closing rib 120 projects from the rear end of the side wall 32 of the front holder 30 of the second embodiment and extends around the entire periphery of the front holder 30. Thus, the closing rib 120 is in the shape of a closed loop that closes the rear end of the holder-side insertion port 38 of the front holder 30.

An upper surface of the closing rib 120 has a guide 121 that inclines towards the holder-side insertion port 38. The guide 121 guides the insertion of the retainer 50 into the holder-side insertion port 38. By wrenching the receiving portion 56 with the jig 101, with the jig 101 can be disposed along the guide 121 and levered to wrench the receiving portion 56 and to move the retainer 50 from the main locking position to the temporary locking position.

The front holder 30 of the second embodiment is mounted on the housing 10 and then the retainer 50 is inserted through the closed loop-shaped holder-side insertion port 38 and into the insertion hole 16 of the main body 12 from so that the end of the retainer 50 is fit in the holder-side insertion port 38. As a result, the retainer 50 is prevented from moving freely widthwise and longitudinally. The closing rib 120 interferes with the rear surface of the retainer 50 and prevents the front holder 30 from moving when a pulling force in the removal direction is applied to the front holder 30. Thus, the front holder 30 cannot be removed from the housing 10.

The invention is not limited to the above-described embodiment described above with reference to the drawings. For example, the following embodiments are included in the technical scope of the present invention.

The lower panel of the side wall of the front holder opposite the panel with the holder-side insertion port may be omitted.

The side panels of the front holder may partly cover two surfaces of the housing.

The retainer to-be-locked portion 42 for holding the retainer may be provided on the housing.

The mating housing may be provided with an erroneous connection prevention rib for preventing the mating housing and the housing from being erroneously fitted in each other. In this case, the erroneous connection prevention rib advances into the ingress hole of the connector housing.

In the second embodiment, the front holder is prevented from being removed from the connector housing owing to the interference between the front holder and the retainer. Therefore it is possible to omit the front holder-locking portion and the front holder to-be-locked portion.

What is claimed is:

1. A connector comprising:

a housing having opposite front and rear ends and cavities extending between the ends for receiving terminal fittings, the housing further having a first side wall and second and third side walls adjacent the first side wall, an insertion hole formed continuously through the first, second and third side walls of said housing and intersecting said cavities, a portion of the insertion hole in the first side wall defining an insertion port;

a retainer inserted into said insertion hole through the insertion port of said housing and locking said terminal fittings inserted into said cavities in a normal state to prevent removal of said terminal fittings; and a front holder mounted on said housing from the front end thereof, the front holder having side panels covering portions of the insertion hole opening in the second third side walls of said housing while keeping said insertion port open, the side panels of the front holder having inner surfaces slidably engaging side surfaces of said retainer.

2. The connector of claim 1, wherein the front holder further has a front wall covering the front end of said housing.

3. The connector of claim 1, wherein at least one retainer lock is provided on a side surface of said retainer, and at least one to-be-locked portion is provided on at least one inner surface of said side panels of said front holder, said retainer lock being locked to said to-be-locked portion when said retainer is inserted into said insertion hole in a normal state to prevent removal of said retainer.

4. The connector of claim 3, wherein, said retainer lock is disposed and dimensioned to expand at least one of said side panels out when said retainer is inserted incompletely into said insertion hole.

5. The connector of claim 1, wherein said wall of said front holder has a closed loop-shaped holder-side insertion port communicating with said insertion hole of said housing; and an end portion of said retainer inserted into said housing in a predetermined normal state is fit in said holder-side insertion port.

6. The connector of claim 5, wherein the front holder has a closing rib at a rear end of the front holder, the closing rib closing closed the rear end of the loop-shaped holder-side insertion port.

7. The connector of claim 6, wherein the closing rib has a slanted surface sloped into the closed loop-shaped holder-side insertion port for guiding an insertion of the retainer into the insertion port.

8. The connector of claim 1, wherein said front holder has a holder-side insertion port that is open at a rear end of said front holder and communicates with said insertion port.

9. A connector comprising:

a housing having opposite front and rear ends and cavities extending between the ends for receiving terminal fittings, the housing further having opposite top and bottom walls and opposite first side wall and second side walls extending between the top and bottom walls, an insertion hole formed continuously through the top wall and portions of the first and second side walls of said housing adjacent the top wall, the insertion hole intersecting said cavities, a portion of the insertion hole in the top wall defining an insertion port;

a retainer inserted into said insertion hole through the insertion port of said housing and locking said terminal fittings inserted into said cavities in a normal state to prevent removal of said terminal fittings; and a front holder mounted on said housing from the front end thereof, the front holder having a front wall covering the front end of the housing, a tubular side wall extending from the front wall of the front holder, the side wall having first and second side panels covering portions of the insertion hole opening in the first and second side walls of said housing while keeping said insertion port open, the side panels of the front holder having inner surfaces slidably engaging side surfaces of said retainer.

10. The connector of claim 9, wherein the side wall of the front holder further includes a top wall covering portions of the top wall of the housing between the front end of the housing and the insertion hole.

11. The connector of claim 10, wherein first and second retainer locks are provided on opposite first and second side surfaces of said retainer , and first and second to-be-locked portions are provided on inner surfaces of said first and second side panels of said front holder, said retainer locks being locked to said to-be-locked portions when said retainer is inserted into said insertion hole in a normal state to prevent removal of said retainer.

* * * * *